US005652414A

United States Patent [19]

Roberts et al.

[11] Patent Number: 5,652,414

[45] Date of Patent: Jul. 29, 1997

[54] ELEVATOR ACTIVE GUIDANCE SYSTEM HAVING A COORDINATED CONTROLLER

[75] Inventors: Randall K. Roberts, Amston; Timothy M. Remmers, Winsted; Clement A. Skalski, Avon, all of Conn.

[73] Assignee: Otis Elevator Company, Farmington, Conn.

[21] Appl. No.: 292,660

[22] Filed: Aug. 18, 1994

[51] Int. Cl.[6] ..... B61B 1/34; B61B 7/04

[52] U.S. Cl. ..... 187/292; 187/394; 187/409

[58] Field of Search ..... 187/292, 391, 187/393, 394, 409, 410

[56] References Cited

U.S. PATENT DOCUMENTS

| | | | |
|---|---|---|---|
| 4,750,590 | 6/1988 | Otala | 187/95 |
| 4,754,849 | 7/1988 | Ando | 187/95 |
| 5,117,946 | 6/1992 | Traktovenko et al. | 187/95 |
| 5,294,757 | 3/1994 | Skalski et al. | 187/115 |
| 5,329,077 | 7/1994 | Skalski et al. | 187/133 |
| 5,379,864 | 1/1995 | Colby | 187/393 |

FOREIGN PATENT DOCUMENTS

| | | |
|---|---|---|
| 0467673 | 1/1992 | European Pat. Off. . |
| 63-87483 | 4/1988 | Japan . |
| 2262166 | 6/1993 | United Kingdom . |
| 2262932 | 7/1993 | United Kingdom . |

OTHER PUBLICATIONS

Hiromi Inaba et al., Attitude Control System of a Super High SApeed Elevator Car Based Upon Magnetic Guides, IECON '94, Bologna Italy, Sep. 5–9, 1994 Sep. 1994.

*Primary Examiner*—Robert Nappi

[57] ABSTRACT

The invention features an elevator system including an elevator car (12) having a frame that operates on guide rails of an elevator shaft of a building. The elevator car (12) has a rigid body motion in a global coordination system (X, Y, Z) kinematically defined by five degrees of freedom including side-to-side translation along the X axis, front-to-back translation along the Y axis, a pitch rotation about the X axis, a roll rotation about the Y axis, and a yaw rotation about the Z axis. The elevator system includes local parameter sensing means (14), responsive to local parameter sensed in each of the five degrees of freedom in the global coordination system (X, Y, Z), for providing local parameter signals ($G_m$, $A_m$); coordinated control means (16), responsive to the local parameter signals ($G_m$, $A_m$), for providing coordinated control signals ($CC_{x1}$, $CC_{x2}$, $CC_{y1}$, $CC_{y2}$, $CC_{y3}$); and local force generating means (18), responsive to the local force coordinated control signals ($CC_{x1}$, $CC_{x2}$, $CC_{y1}$, $CC_{y2}$, $CC_{y3}$), for providing coordinated local forces ($F_{x1}$, $F_{x2}$, $F_{y1}$, $F_{y2}$, $F_{y3}$) to maintain desired gaps between the frame and the guide rails to coordinate the position of the elevator car (12) with respect to the elevator shaft of the building.

24 Claims, 16 Drawing Sheets

ELEVATOR ACTIVE GUIDANCE SYSTEM HAVING A COORDINATED CONTROLLER

This invention relates to elevators and, more particularly, to elevators having improved ride quality.

BACKGROUND OF THE INVENTION

Elevator systems are always being designed to move faster, smoother and more intelligently up and down an elevator shaft of a building. One area of recent intensive improvement has been in reducing horizontal vibrations.

A conventional elevator system has a car platform with a support frame which operates with guide rails arranged in the elevator shaft of the building, and a passive suspension system for controlling mechanical forces between the car platform, the supporting frame, and the guide rails as the elevator car moves up and down the elevator shaft. For example, the elevator car platform is typically attached to the support frame with hard rubber pads, and the supporting frame, in turn, moves along the guide rails supported by either wheels having stiff springs or sliding gibs at four attachment points. There is typically a limited amount of space between the supporting frame and the guide rails. Because of this soft springs cannot be used and any anomalies in the guide rails can cause significant vibration in the car platform. In addition, the ride quality is typically affected by low frequency mechanical forces produced by low frequency forces on the elevator such as forces produced by offset load or wind buffeting of the building or passenger motions in the car platform and high frequency forces produced between the frame and the guide rails as the elevator moves up and down the elevator shaft. The low frequency mechanical forces have high stiffness requirements, while the high frequency mechanical forces have low stiffness requirements.

One disadvantage of the elevator system having the passive suspension system are that stiff springs and guide rail anomalies combine to cause significant car platform vibration and that the ride quality is compromised due to the inherent trade-off between mitigation of low frequency forces versus the high frequency mechanical forces. Moreover, another disadvantage with the conventional elevator is that significant levels of acoustic noise are produced and transmitted to the elevator cab by the guide wheels as they move along guide rails.

These problems are overcome by an elevator systems having an active guidance system (hereinafter referred to as the "AG system") as described, inter alia, in European patent application No. 0 467 673 and U.S. Pat. Nos. 5,321,217; 5,304,751; 5,294,757; 5,308,938; 5,322,144. The AG system has an active suspension system for controlling mechanical forces between the supporting frame of the elevator/cab and the guide rails as the elevator moves up and down the elevator shaft. In the AG systems, the support frame has active roller guides, magnetic guide heads or other active horizontal suspensions which operate with the guide rails, and a controller for independently controlling one or more selected parameters indicative of horizontal vibrations or movements in a servo control loop as the elevator moves up and down within the elevator shaft.

However, the known AG systems utilize localized controllers which attempt to independently control the physical relationship between the guide heads, roller guides, slide guides, etc., and the guide rails in each axis of motion. These localized controllers do not share information. One disadvantage of an AG system having localized controllers is that forces which control one axis can have an adverse effect on other axes.

The proposed elevator AG system utilizes a coordinating controller which attempts to decouple the system dynamics by transforming the effective control into a global coordinate system aligned with the principle axis of the elevator car. By sharing information (sensing and actuation) from each guide head this system can minimize the amount of dynamic coupling (i.e., minimize the off-diagonal terms in the system plant transfer function) thereby allowing effective single-input/single-output (SISO) control logic to be developed for each axis of control in the new global coordinate system. This is an improvement over AG systems which use localized control whose performance is restricted by unmodeled and uncompensated dynamic interactions.

SUMMARY OF THE INVENTION

The invention features an elevator AG system including an elevator car having a frame that operates on guide rails of an elevator shaft of a building. The elevator car has a rigid body motion in a global coordination system (X, Y, Z) kinematically defined by five degrees of freedom including side-to-side translation along the X axis, front-to-back translation along the Y axis, a pitch rotation about the X axis, a roll rotation about the Y axis, and a yaw rotation about the Z axis. The elevator AG system includes local parameter sensing means, responsive to local parameters sensed in each of the five degrees of freedom in the global coordination system (X, Y, Z), for providing local parameter signals; coordinated control means, responsive to the local parameter signals, for providing coordinated control signals; and local force generating means, responsive to the coordinated control signals, for providing local coordinated forces to maintain desired parameters in a coordinate fashion.

An object of the invention is to provide an AG system in which the physical relationship between each active guide and a selected referent such as a guide rail is coordinately controlled.

A feature of the invention is to provide the AG system having a coordinated controller which utilizes sensor information from all the active guides and which generates coordinated forces and movements to all active guides simultaneously. In effect, the coordinated controller coordinates the guidance system which minimizes the system dynamic coupling, and which effectively decouples the system dynamics thereby maximizing the achievable feedback bandwidths of position feedback control (to keep the car nominally centered it its travel range) and accelerometer feedback control (to reduce the car's horizontal vibration level and therefore magnetic bearing stiffnesses).

For active magnetic guidance (AMG) systems, the coordinated controller is an important improvement due to the high magnetic bearing stiffness (i.e. position feedback control bandwidth) required due to relatively small tolerances between the guide heads and guide rail (i.e. a few millimeters) and the potentially large reaction forces required to center an imbalanced car.

In addition, an AG system can utilize the coordinated control in an elevator system in conjunction with a priori knowledge of guide rail profile data to minimize rail-induced car vibrations, which eliminates the need for guide wires (see U.S. Pat. No. 4,754,849) for position referencing.

A further advantage of the invention is the reduction of cab vibration, noise levels and maintenance of elevator systems. In particular, the invention can reduce cab vibration levels by an order of magnitude.

DESCRIPTION OF THE DRAWING

For a fuller understanding of the nature and objects of the invention, reference should be made to the following detailed description taken in connection with the accompanying drawings in which:

FIG. 9(*a*) shows another embodiment of the present invention in the form of a Simulink diagram.

FIG. 9(*b*) shows still another embodiment of the present invention in the form of a Simulink diagram.

DESCRIPTION OF THE BEST MODE FOR CARRYING OUT THE INVENTION

I. The Overall AG Elevator System

Figure 1:
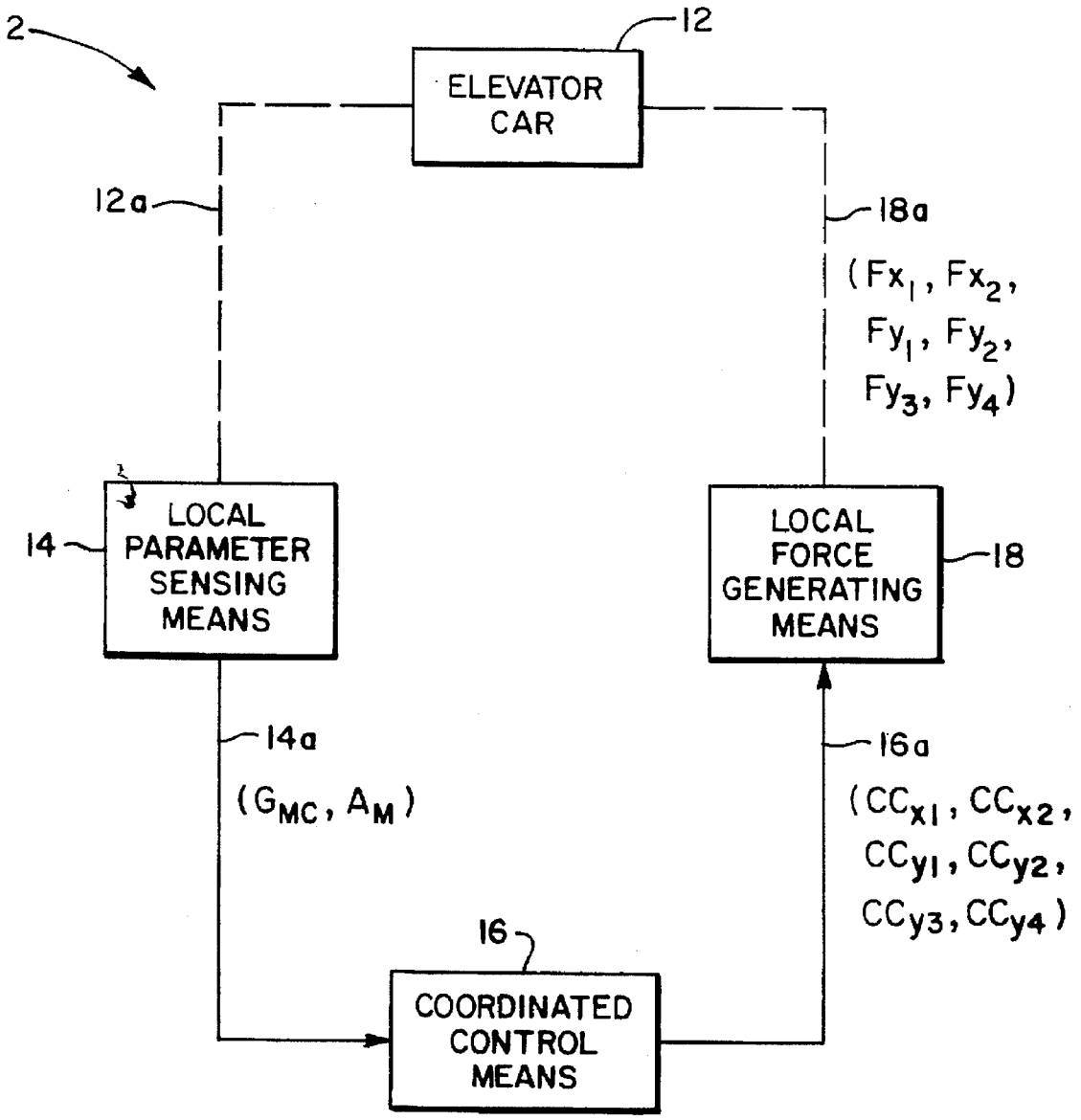
FIG. 1 is a block diagram of an elevator AG system of the invention.

In general, FIG. 1 shows an active guidance (AG) elevator system 2 for controlling horizontal movements of an elevator car 12 in an elevator shaft (not shown) of a building (not shown). The elevator car 12 is shown in detail in FIG. 2 and has a car frame 13 with four guide heads 10, 20, 30, 40, which are shown in this example as magnetic guide heads. It should be realized, however, that the guidance system of the present invention is applicable to an elevator system having a plurality of active guides of any type, including active roller guides, active slide guides, etc. The car 12 moves upwardly and downwardly along rails such as guide rail 20*a* in FIGS. 3–5. In this illustrated case of FIG. 2, the AG elevator system 2 is thus an active magnetic guidance (AMG) system which controls the global position of the elevator car 12 with respect to the elevator shaft (not shown) as a function of the local position between the guide heads and the rails.

In general, however, as shown in FIG. 1, the elevator system 2 features a local parameter sensing means 14, a coordinated control means 16, and a local force generating means 18, which cooperate to control the horizontal motion of the elevator car 12 with respect to a selected referent.

Figure 2:
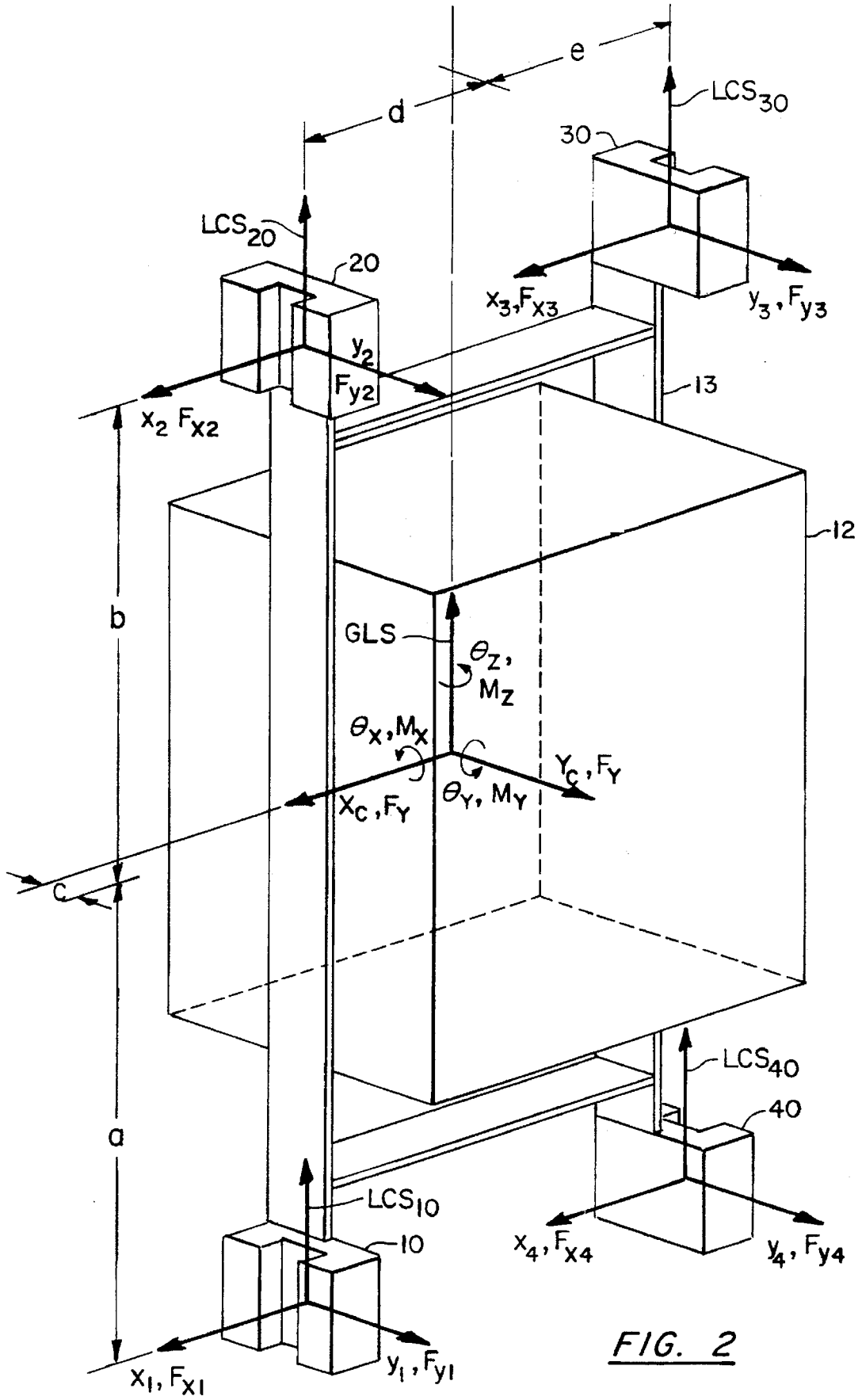
FIG. 2 is a schematic of an elevator car 12 in an AMG system.

For the example of FIG. 2, the local parameter sensing means 14 is responsive to a local parameter sensed in each of the five rigid body degrees of freedom in the global coordination system GCS having X, Y, Z axes, for providing local parameter signals $G_m$, $A_m$. For example, the local parameter signals $G_m$, $A_m$ include local air gaps $G_m$ sensed between guide heads 10, 20, 30, 40 and guide rails (not shown), and local acceleration signals $A_m$ sensed at the guide heads 10, 20, 30, 40. In response thereto, the local parameter sensing means 14 provides associated locally sensed parameter signals on line 14*a*, represented by the dashed line 12*a*. The local parameter sensing means 14 of the example of FIG. 2 is shown and described in detail below with respect to FIGS. 3–5.

The coordinated control means 16 for the example of FIG. 2 is responsive to the local parameter signals $G_m$, $A_m$, for providing coordinated control signals $CC_{x1}$, $CC_{x2}$, $CC_{y1}$, $CC_{y2}$, $CC_{y3}$ on the line 16*a*. The coordinated control means 16 for the example of FIG. 2 is shown in detail and described below with respect to FIGS. 6, 7, 8, 9 and 9(*a*). The coordinated control means 16 utilizes information gathered from all the guide heads in the form of the local parameter signals $G_m$, $A_m$, and provides the coordinated control signals $CC_{x1}$, $CC_{x2}$, $CC_{y1}$, $CC_{y2}$, $CC_{y3}$ on the line 16*a* in a coordinated manner which harmonizes the multi-axis movements of the elevator car 12 simultaneously.

The local force generating means 18 is responsive to the coordinated control signals $CC_{x1}$, $CC_{x2}$, $C_{y1}$, $CC_{y2}$, $CC_{y3}$ on the line 16*a*, for providing coordinated local forces $Fx_1$, $Fx_2$, $Fy_1$, $Fy_2$, $Fy_3$, on a dashed line 18*a* to maintain desired gaps between the guide heads 10, 20, 30, 40 and the guide rails to coordinate the position of the elevator car 12 with respect to the elevator shaft of the building. The local force generating means 18 may include magnetic drivers/electromagnets which are discussed below.

As shown in FIG. 2, the rigid body motion of the elevator car 12 is kinematically defined in the five degrees of freedom of the global coordination system GCS having X, Y, Z axes by side-to-side translation along the X axis, front-to-back translation along the Y axis, a pitch rotation about the X axis, a roll rotation about the Y axis, and a yaw rotation about the Z axis. As shown, the global coordinate system GCS has its origin at the geometric (or mass) center of the elevator car 12. The side-to-side linear translation $X_C$ is measured along the X axis in the global coordinate system GCS and a force $F_X$ is defined along the X axis. The front-to-back linear translation $Y_C$ is measured along the Y axis in the global coordinate system GCS, and a force $F_Y$ is defined along the Y axis. The pitch rotation $\theta_X$ is rotationally measured about the X axis in the global coordinate system GCS, and a moment $M_X$ is defined about the X axis. The roll rotation $\theta_Y$ is rotationally measured about the Y axis in the global coordinate system GCS, and a moment $M_Y$ is defined about the Y axis. The yaw rotation $\theta_Z$ is measured about the Z axis in the global coordinate system GCS, and a moment $M_Z$ is defined about the Z axis. Each of the three rotational arrows shown in FIG. 2 indicates the direction of a positive moment about the respective axes. (Note that for the purposes of this discussion the measurement and motion of the elevator car 12 are not controlled by the AMG system with respect to translations in the Z axis.)

In addition, each guide head 10, 20, 30, 40 has a respective local coordinate system $LCS_{10}$, $LCS_{20}$, $LCS_{30}$, $LCS_{40}$, having $x_i$, $y_i$, $z_i$ axes. For example, the guide head 10 has a local coordinate system $LCS_{10}$ having an $x_1$ axis and a $y_1$ axis with forces $F_{x1}$ and $F_{y1}$ respectively defined along these axes, as shown. The guide head 20 has a local coordinate system $LCS_{20}$ having an $x_2$ axis and a $y_2$ axis with forces $F_{x2}$ and $F_{y2}$ respectively defined along these axes, as shown. The guide head 30 has a local coordinate system $LCS_{30}$ having an $x_3$ axis and a $y_3$ axis with forces $F_{x3}$ and $F_{y3}$ respectively defined along these axes, as shown. The guide head 40 has a local coordinate system $LCS_{40}$ having an $x_4$ axis and a $y_4$ axis with forces $F_{x4}$ and $F_{y4}$ respectively defined along these axes, as shown.

For each of the four guide heads 10, 20, 30, 40, its three respective electromagnets produce forces $F_{x1}$, $F_{y1}$, $F_{x2}$, $F_{y2}$, $F_{x3}$, $F_{y3}$, $F_{x4}$ and $F_{y4}$ along the respective local $x_i$ and $y_i$ axes. It is assumed that the local forces along the $x_i$ and $y_i$ axes act through the origin of its respective local coordinate system $LCS_i$. One could easily account for any offset in the local $z_i$ axis between these two forces due to magnet positioning by adding additional length parameters in this kinematic characterization. What follows is a description of the elevator AG system implemented on an elevator in which the local sensing means 14 and local force generating means 18 are co-located on guide heads whose position can he approximated by a single point. Gap sensors, accelerometers, and force generators are described which sense or act on the same point on the elevator. Anyone skilled in the art of kinematic analysis would be able to extend this description to systems in which this approximation were not true. In particular, the developed kinematic transformation matrices (T1, T3, and T4) would be modified based on this new alternate system geometry.

The local coordinate systems $LCS_{10}$, $LCS_{20}$, $LCS_{30}$, $LCS_{40}$ are related to the global coordinate system GCS based on five lengths a, b, c, d and e, as shown in FIG. 2. The lengths a and b define the lever arms for the pitch rotation $\theta_X$ about the X axis and the roll rotation $\theta_Y$ about the Y axes. The lengths c, d and e define the lever arms for the yaw rotation $\theta_Z$ about the Z axis. For the typical case, one assumes a=b, d=e and c=0. A discussion of how the five lengths a, b, c, d and e are used in the AMG system is discussed below with respect to FIGS. 6–8.

In one embodiment, discussed below, the position of the elevator car 12 is measured in three of the four local coordinate systems $LCS_{10}$, $LCS_{20}$, $LCS_{30}$ and coordinated local forces $F_{x1}$, $F_{x2}$, $F_{y1}$, $F_{y2}$, $F_{y3}$ are applied in the same three local coordinate systems $LCS_{10}$, $LCS_{20}$, $LCS_{30}$. The measurements are used to determine the deviation of the elevator car 12 from a desired position in the global coordinate system GCS, and the forces necessary to move the elevator car 12 back to the desired position in the global coordinate system GCS. In an alternative embodiment, discussed below, the position of the elevator car 12 is measured in all four local coordinate systems $LCS_{10}$, $LCS_{20}$, $LCS_{30}$, $LCS_{40}$ and coordinated local forces $F_{x1}$, $F_{x2}$, $F_{y1}$, $F_{y2}$, $F_{y3}$, $F_{y4}$ are applied in the all four local coordinate systems $LCS_{10}$, $LCS_{20}$, $LCS_{30}$, $LCS_{40}$.

II. The Local Parameter Sensing Means 14

Figure 3:
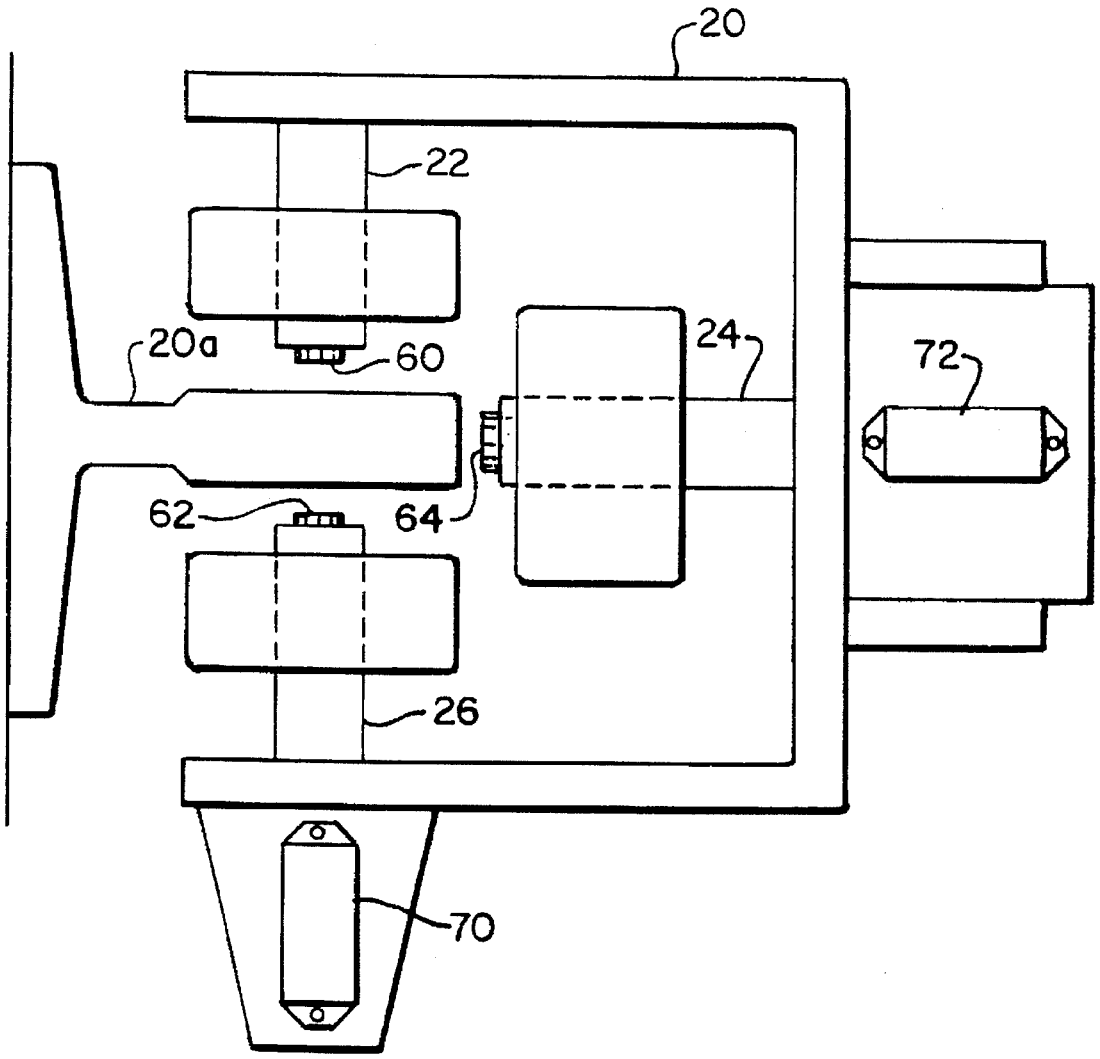
FIG. 3 is a top view of a typical active magnetic guide head of the elevator car shown in FIG. 2.

As shown in FIG. 3, a typical guide head such as the guide head 20 of FIG. 2 includes three electromagnets 22, 24 and 26. The electromagnets 22 and 26 are located in the back and front respectively of the guide rail 20*a* and exert forces in the $y_2$ axis, which is also referred to herein as the front-to-back (f/b) axis. The electromagnet 24 exerts a force in the $x_2$ axis, which is also referred to herein as the side-to-side (s/s) axis. The force developed and exerted by each magnet is detected by magnetic flux sensors on each magnet pole face, i.e a flux sensor 60 on electromagnet 22, a flux sensor 64 on electromagnet 24, and a flux sensor 62 on electromagnet 26. The induced magnetic force is proportional to a respective square of each sensed flux signal. The flux sensors are axial flux sensors, because of the shape of the rail. The scope of the invention is not intended to be limited to any particular type of flux sensor. For example, transverse flux sensors might be used if the guide rails had a different shape.

Figure 4:
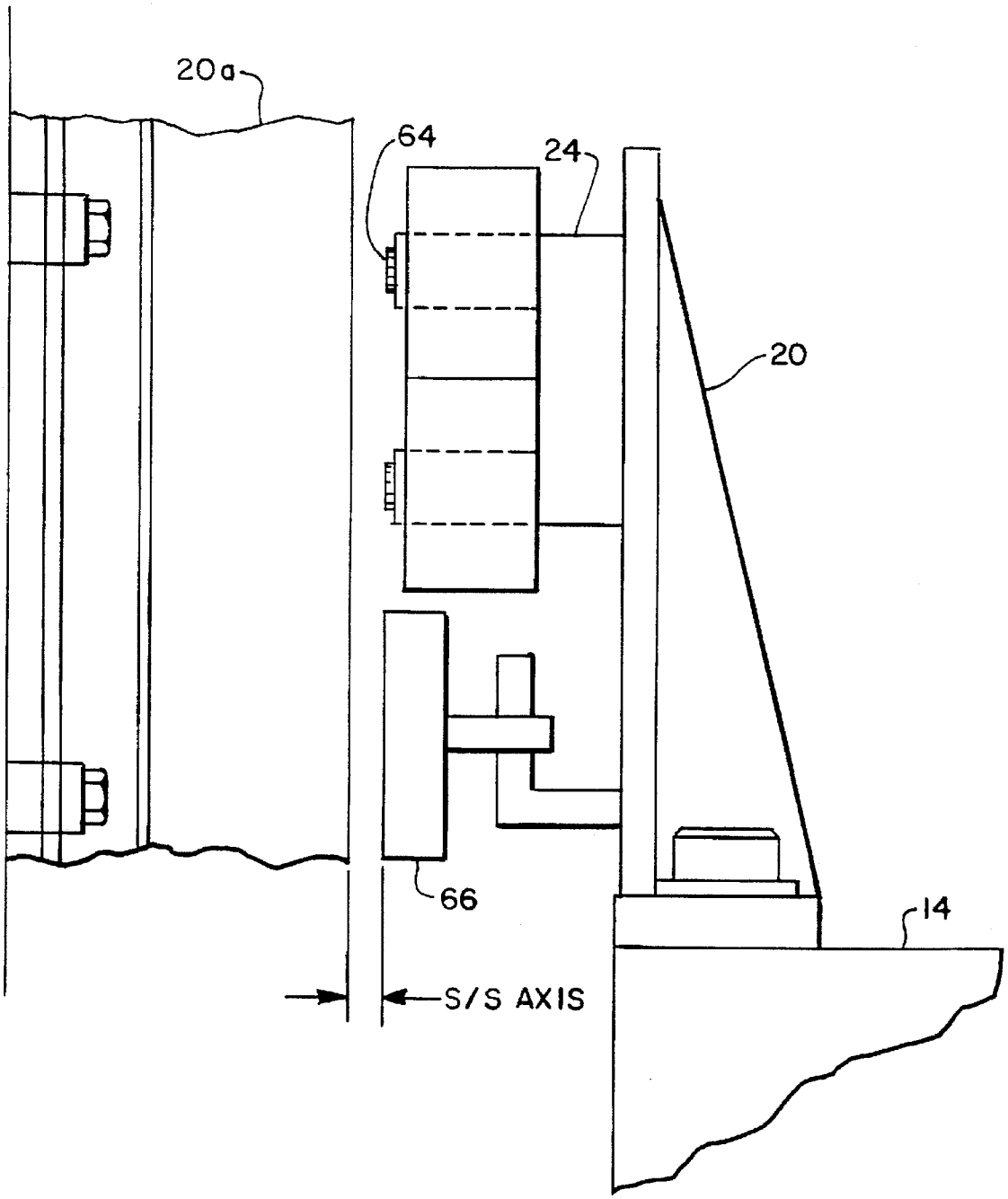
FIG. 4 is a side view of the side-to-side axis of the active magnetic guide head shown in FIG. 3.

The position of the guide head 20 relative to the guide rail 20*a* is measured locally along both the $x_2$ and $y_2$ axes using non-contacting air gap sensors. As shown in FIG. 4, the guide head 20 includes a non-contacting air gap sensor 66 for measuring the side-to-side (s/s) air gap along the $x_2$ axis between the guide rail 20*a* and the electromagnet 24.

Figure 5:
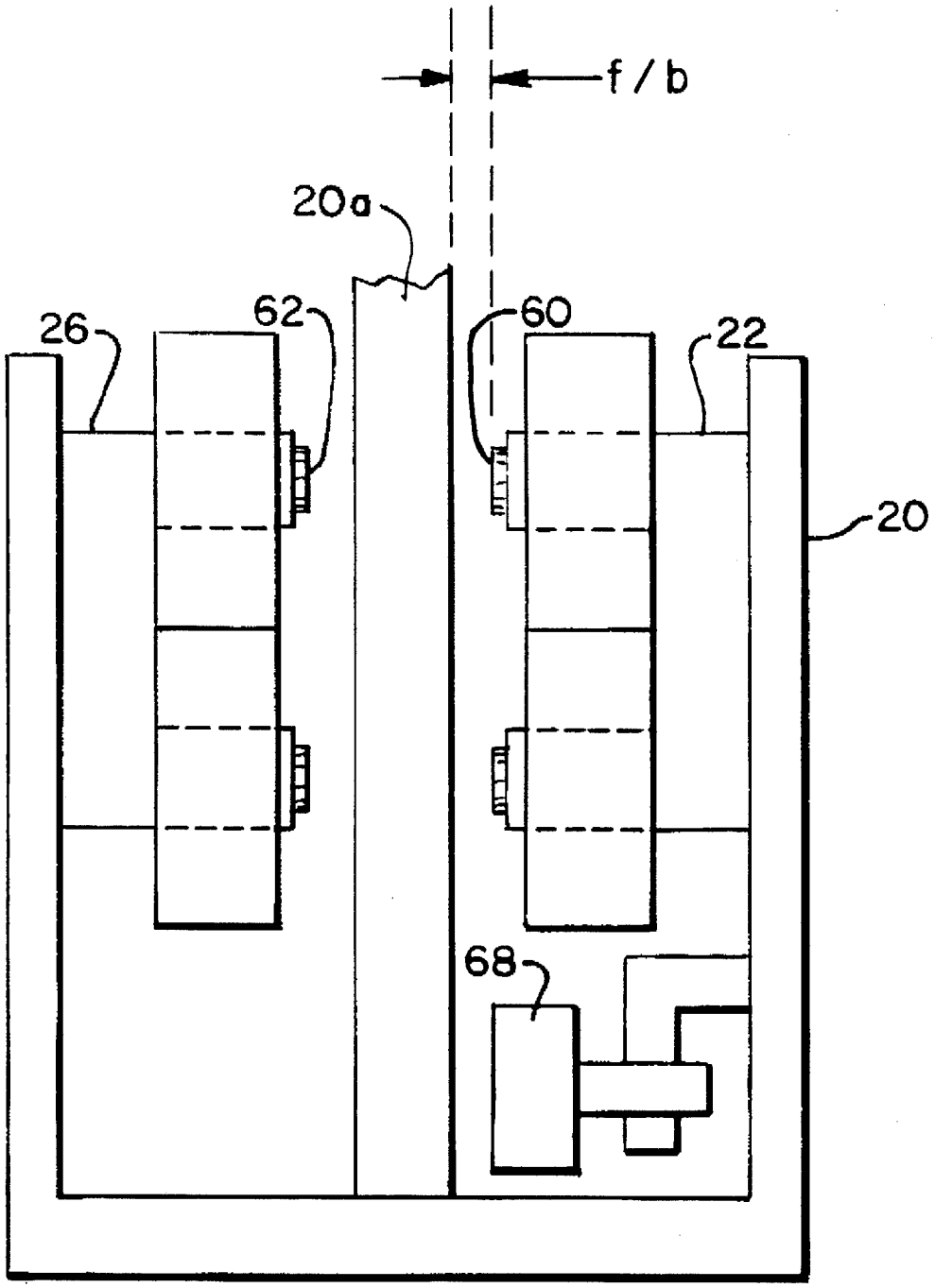
FIG. 5 is a side view of the front-to-back axis of the active magnetic guide head shown in FIG. 3.

As shown in FIG. 5, the guide head 20 also includes a non-contacting air gap sensor 68 for measuring the front-to-back (f/b) gap along the $y_2$ axis between the guide rail 20*a* and the electromagnet 20. The non-contact air gap sensors 66, 68 are known in the art. Information from the non-contact air gap sensors 66, 68 is processed to determine the amount of rigid body motion and dynamic car twist the elevator car 12 has experienced and is used to provide force commands to the local force generating means 18.

In addition, as shown in FIG. 3 the guide head 20 may also include accelerometers 70 and 72 on guide head 20. Similar accelerometers are located on the other three guide heads 10, 30, 40. The accelerometers 70 and 72 sense side-to-side (s/s) and front-to-back (f/b) car accelerations at the guide heads 10, 20, 30, 40. The sensed local acceleration signals $A_m$ may be used in an acceleration feedback loop, discussed in detail below.

III. The Coordinated Control Means 16

Figure 6:
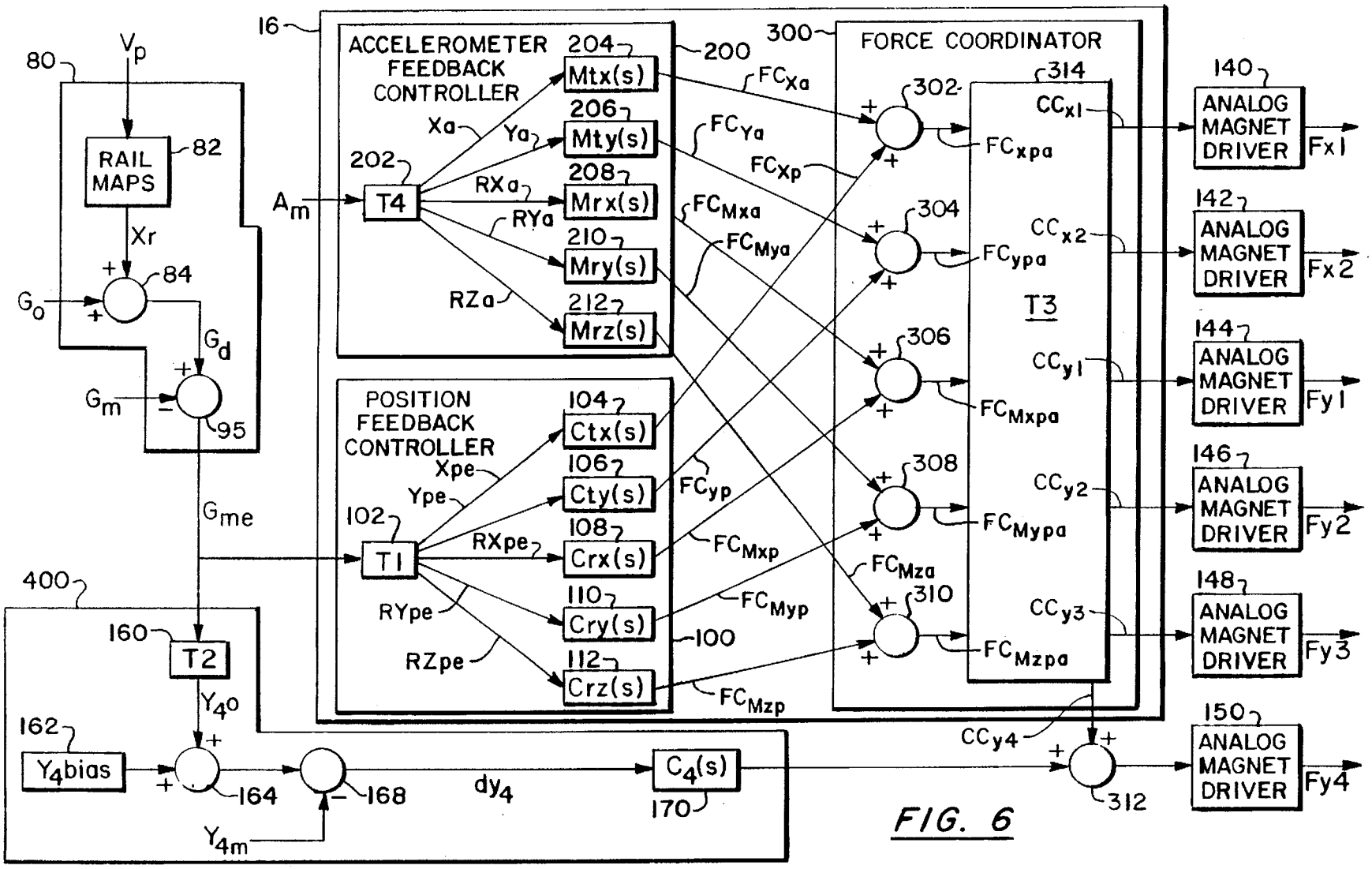
FIG. 6 is a block diagram of a mathematical representation of the coordinated controller 16 shown in FIG. 1.

FIG. 6 shows in detail the coordinated controller means 16 in FIG. 1. The heart of the AG centering and vibration control system is the method of processing local parameter signals, including local air gaps and acceleration signals, to determine equivalent rigid body motions at the global coordinate system GCS. In general, the best performance (i.e. highest bandwidth position and accelerometer feedback control) will be achieved when the global coordinate system GCS is coincident with the center-of-gravity of the elevator as this minimizes the amount of dynamic cross-coupling in the system response. There are four basic control logic elements in the coordinated controller of the AG system: position feedback coordinated controller 100, accelerometer feedback coordinated controller 200, force coordinator 300, and a dynamic frame flex controller 400, all discussed in detail below.

For the illustrated embodiment, there are three basic input signals to the elevator control system: the air gap signals sensed between the guide heads 10, 20, 30, 40 and the respective guide rail, represented by the vector $G_m$, the acceleration signals sensed at the four guide heads 10, 20, 30, 40, represented by the vector $A_m$, and vertical position sensed with respect to the position of the elevator car 12 in the elevator shaft (not shown), represented by a parameter Vp. The air gap signals $G_m$, the acceleration signals $A_m$, and the vertical position signals Vp all influence the coordinated controller means 16 and determine how it controls the movement of the elevator car as it moves up and down in the elevator shaft.

A. A Learned-Rail System 80

FIG. 6 shows that the AG elevator system 12 includes a learned-rail system 80 which compensates for rail irregularities in an open-loop or anticipatory fashion using a technique disclosed in U.S. Pat. No. 5,524,730. In that technique, the acceleration and position parameter signals are sensed during an elevator run, are combined, and stored in a computer memory as information about rail displacement indexed as a function of elevator vertical position, for creating a rail profile irregularity map 82 as shown in FIG. 6. During operation, the values for the desired air gaps $G_d$, where $G_d=G_{d10}$, $G_{d20}$, $G_{d30}$ are augmented with correction rail profile displacement information based on a table lookup using the elevator vertical position. For example, the desired air gaps $G_d$ are determined by summing desired nominal gaps, $G_o$, and estimated rail irregularities, Xr, at the vertical position Vp of the elevator cab.

As shown, the rail profile irregularity map 82 is responsive to a vertical position signal Vp of the elevator car 12, for providing the estimated rail map irregularity signals Xr. A summing circuit 84 is responsive to the estimated rail map irregularity signals Xr, and is further responsive to the desired nominal gap signals $G_o$, for providing the desired air gap signals $G_d$, which represents the desired air gaps at the respective guide heads 10, 20, 30, 40.

According to the present invention, the air gap signals $G_m$ sensed at the guide head 10, 20, 30, 40 in the local coordinate systems $LCS_{10}$, $LCS_{20}$, $LCS_{30}$, $LCS_{40}$. $G_m$ represent the actual local air gap signals sensed by the five local gap sensors discussed above for being compared to the desired nominal gaps $G_o$ augmented by the learned-rail signals Xr in closed loop fashion to provide position error signals $G_{me}$ that are determined by subtracting the sensed air gap signals $G_m$ from the desired local gap signals $G_d$. As shown, a subtracting means 95 is responsive to the air gap signals $G_m$ and the desired air gap signals $G_d$, for providing position error signals $G_{me}$ in the form of local position error signals $x_{1pe}$, $x_{2pe}$, $y_{1pe}$, $y_{2pe}$, $y_{3pe}$.

The scope of the invention is not intended to be limited to embodiments using such a learned-rail system 80. In an AG system 12 without a learned-rail system, the air gap error signals $G_m$ are compared only to the desired nominal gap signals $G_o$ and the difference is provided to the coordinated control 16 as position error signals $G_{me}$.

B. Position Feedback Controller 100

In general, the position feedback controller 100 is responsive to local position error signals $G_{me}$, for providing coordinated global force (along an axis) or moment (about an axis) position feedback signals $FC_P$. The local position error signals $G_{me}$ represent the dimension of the air gaps measured in millimeters between the guide heads 10, 20, 30, 40 and the guide rails, and the coordinated global force or moment position feedback signals $FC_P$ represent the global force or moment feedback measured in newtons that corresponds to the local position error signals $G_{me}$.

The desired components of global coordinated force or moment position feedback signals $FC_p$ at the guide heads 10, 20, 30, 40 are obtained by the equation:

$$\{FC_P\}=[C(s)][T_1]\{G_{me}\},$$

where $FC_P=[FC_{Xp}, FC_{Yp}, FC_{Mxp}, FC_{Myp}, FC_{Mzp}]$, where $[C(s)]=\text{diag}\ [Ctx(s), Cty(s), Crx(s), Cry(s), Crz(s)]$, where $G_{me}=[x_{1pe}, x_{2pe}, y_{1pe}, y_{2pe}, y_{3pe}]$, and where the matrix $T_1$ mathematically represents a transformation matrix used by a local-to-global coordinated position feedback controller 102. The air gap error signals $G_{me}$ in the local coordinate systems $LCS_{10}$, $LCS_{20}$, $LCS_{30}$, $LCS_{40}$ are thus converted to coordinates in the five degrees-of-freedom GCS coordinates by the local-to-global coordinated position feedback controller 102. The resulting coordinated global position error signals $X_{pe}$, $Y_{pe}$, $RX_{pe}$, $RY_{pe}$, $RZ_{pe}$ are then fed into position feedback controllers 104–112, represented by the matrix for [C(s)], which provide the coordinated global force or moment position feedback compensation signals $FC_{Xp}$, $FC_{Yp}$, $FC_{Mxp}$, $FC_{Myp}$, $FC_{Mzp}$.

To do this, the coordinated controller 16 in its broadest sense utilizes local gap signals from five local gap sensors measured along the $x_1$, $x_2$, $y_1$, $y_2$ and $y_3$ axes in three of the guide heads 10, 20, 30. In the embodiment shown, gap sensors 66 and 68 in FIG. 4 and 5, respectively, provide measured gap signals along the $x_2$ and $y_2$ axes in guide head 20, while similar gap sensors 66', 68' (not shown) provide similar measured gap signals along the $x_1$, $y_1$ axes in guide head 10, and a similar gap sensor 68" (not shown) provides a similar measured signal along the $y_3$ axis in guide head 30. Anyone skilled in the art of kinematic analysis could derive similar relationships for other sensor combinations in other combinations of guide heads.

The rigid body motion in the global coordinate system GCS is determined from the local gap signals from these five local gap sensor by using the linear equation 1, as follows:

$$\begin{bmatrix} x_1 \\ x_2 \\ y_1 \\ y_2 \\ y_3 \end{bmatrix} = \begin{bmatrix} 1 & 0 & 0 & -a & -c \\ 1 & 0 & 0 & b & -c \\ 0 & 1 & a & 0 & d \\ 0 & 1 & -b & 0 & d \\ 0 & 1 & -b & 0 & -e \end{bmatrix} \begin{bmatrix} X_C \\ Y_C \\ \theta_X \\ \theta_Y \\ \theta_Z \end{bmatrix} \qquad \text{Eq. (1)}$$

where a, b, c, d and e, as previously discussed in connection with FIG. 2, relate the local coordinate systems $LCS_{10}$, $LCS_{20}$, $LCS_{30}$ and $LCS_{40}$ to the global coordinate system GCS; $X_C$ is the side-to-side translation; $Y_C$ is the front-to-back translation; and $\theta_X$ is the pitch rotation, $\theta_Y$ is a roll rotation, and $\theta_Z$ is a yaw rotation, discussed above, and $x_1$, $x_2$, $y_1$, $y_2$ and $y_3$ are sensed side-to-side and front-to-back measurements at the respective guide heads 10, 20 and 30 respectively. Equation 1 enables the guide head positions to be predicted as a function of the position of the center of the elevator car 12.

In effect, Equation 1 is compact mathematical notation for a set of linear equations as follows:

$$x_1 = X_C - a\theta_Y - c\theta_Z,$$

$$x_2 = X_C + b\theta_Y - c\theta_Z.$$

$$y_1 = Y_C + a\theta_X\, d\theta_Z,$$

$$y_2 = Y_C - b\theta_X + d\theta_Z, \text{ and}$$

$$y_3 = Y_C - b\theta_X - e\theta_Z,$$

wherein a positive sign indicates a rotation in the direction of the arrow in FIG. 2 and a negative sign indicates a rotation in an opposite direction from the arrow. Note that the values of the five lengths a, b, c, d and e of FIG. 2 represent the values of the similarly labelled coefficients in the T1 matrix as any person skilled in the art would appreciate.

By inverting Equation 1, one can readily show that the rigid body motions in the global coordinate system GCS can be determined from the local gap error signals by Equation 2, as follows:

$$\begin{bmatrix} X_C \\ Y_C \\ \theta_X \\ \theta_Y \\ \theta_Z \end{bmatrix} = \begin{bmatrix} \frac{b}{a+b} & \frac{a}{a+b} & 0 & \frac{c}{d+e} & \frac{-c}{d+e} \\ 0 & 0 & \frac{b}{a+b} & \frac{ae-be}{(a+b)(d+e)} & \frac{d}{d+e} \\ 0 & 0 & \frac{1}{a+b} & \frac{-1}{a+b} & 0 \\ \frac{-1}{a+b} & \frac{1}{a+b} & 0 & 0 & 0 \\ 0 & 0 & 0 & \frac{1}{d+e} & \frac{-1}{d+e} \end{bmatrix} \begin{bmatrix} x_1 \\ x_2 \\ y_1 \\ y_2 \\ y_3 \end{bmatrix} \quad \text{Eq. (2)}$$

Equation 2 is an inverse of equation 1 and enables one to predict the position of the center of the elevator car 12 as a function of the local positions of the guide heads 10, 20 and 30.

In effect, Equation 2 is also compact mathematical notation for a set of linear equations as follows:

$$X_C = x_1 b/(a+b) + x_2 a/(a+b) + y_2 c/(d+e) - y_3 c/(d+e),$$

$$Y_C = y_1 b/(a+b) + y_2(ae-be)/(a+b)(d+e) + y_3 d/(d+e),$$

$$\theta_X = x_1/(a+b) - y_2/(a+b),$$

$$\theta_Y = -x_1/(a+b) + x_2/(a+b), \text{ and}$$

$$\theta_Z = y_2/(d+e) - y_3/(d+e),$$

By solving these equations, the coordinated global displacement errors $X_C$, $Y_C$, $\theta_X$, $\theta_Y$, $\theta_Z$ in the global coordinate system GCS are determined, i.e., how much the center of the elevator car 12 has deviated from its desired center position.

In particular, the local-to-global position feedback controller 102 is responsive to the local position error signals $x_{1pe}$, $x_{2pe}$, $y_{1pe}$, $y_{2pe}$, $y_{3pe}$, for providing coordinated global position error signals $X_{pe}$, $Y_{pe}$, $RX_{pe}$, $RY_{pe}$, $RZ_{pe}$ according to Equation (2). The local-to-global position feedback controller 102 translates local displacement error signals sensed in the local coordinate systems $LCS_{10}$, $LCS_{20}$, $LCS_{30}$ into a coordinated global displacement error in the global coordinate system GCS. The local-to-global centering coordinated controller 102 can be implemented either by an analog or digital system. As shown, $G_{me}$ mathematically represents a vector of errors processed by the centering controller 100 to generate a requested set of forces and moments in the global coordinate system GCS. The scope of the invention is not intended to be limited to only five local input signals. For example, as discussed below, the local position error signals can include an additional signal $y_{4pe}$ measured at the guide head 40, without deviating from the scope of the invention.

B. Accelerometer Feedback Controller 200

As shown in FIG. 6, the coordinated control means 16 also includes an accelerometer feedback controller 200 that coordinates the control of damping and vibration in the elevator car.

The accelerometer feedback controller 200 is responsive to local acceleration signals $A_m$, for providing coordinated global force or moment acceleration feedback signals $FC_A$, where $A_m=[x_{1a}, x_{2a}, y_{1a}, y_{2a}, y_{3a}]$ and where $FC_A=[FC_{Xa}, FC_{Ya}, FC_{Mxa}, FC_{Mya}, FC_{Mza}]$.

The desired components of global coordinated force or moment acceleration feedback signal at the guide heads 10, 20, 30, 40 are derived from $FC_A$ by the equation:

$$\{FC_A\}=[M][T_4]\{A_m\},$$

where [M]=diag[Mtx(s), Mty(s), Mrx(s), Mry(s), Mrz(s)] and where the matrix T4 mathematically represents a transformation matrix used by a local-to-global accelerometer coordinated controller 202.

The acceleration signals $A_m$ sensed by the accelerometers 70, 72, etc are processed by the accelerometer feedback controller 200 to mitigate cab and frame vibrations using acceleration feedback compensation. The acceleration signals $A_m$ are local signals converted to coordinates in the five degrees-of-freedom in the global coordinate system GCS by the local-to-global accelerometer coordinated controller 202. T4 mathematically represents a transformation matrix T4 used by the local-to-global accelerometer coordinated controller 202.

The local-to-global accelerometer coordinated controller 202 is responsive to the local acceleration signals $x_{1a}$, $x_{2a}$, $y_{1a}$, $y_{2a}$, $y_{3a}$, for providing coordinated global acceleration signals $X_A$, where $X_A=[X_a, Y_a, RX_a, RY_a, RZ_a]$. The transformation functions for determining a matrix T4 in the local-to-global accelerometer coordinated controller 202 are very similar in nature to the transformation functions for determining the matrix T1 in the position feedback controller 102 as taught above.

However, it should be realized that if the location of the accelerometers is significantly different from the location of the gap sensors, then the kinematics for determining the transformation matrix T1 could be different from the kinematics for determining the transformation matrix T4. If the accelerometer is in close proximity to the gap sensor, then the transformation functions of T1 and T4 can be assumed to be substantially identical. If the accelerometer is not in close proximity to the gap sensor, then it should be realized that an appropriate transformation function T4 has to be identified.

C. Position and Accelerometer Feedback Compensators

To illustrate some features of the proposed elevator AG system, an analysis of the design of the position and acceleration feedback compensators 104, 106, . . . , 112, 204, 206, . . . , 212, mathematically represented as C(s) and M(s) respectively, will be presented. In this discussion, a single axis of control will be examined based on the assumption that the position feedback coordinated controller 102, the acceleration feedback coordinated controller 202, and the force coordinator 300 effectively decouple the system dynamics. The elevator dynamics are represented as a pure inertia in this simplified analysis which is not intended to be a rigorous assessment of the stability and performance of the proposed feedback compensators but is rather included to illustrate typical features and issues associated with the compensation design. Anyone skilled in the art of feedback compensator design would recognize the impact that elevator cab and frame structural dynamics, position sensor and accelerometer dynamic response and noise characteristics, actuator (i.e., force generator) dynamics, and controller hardware characteristics have on the design of the position feedback compensators, C(s), and the acceleration feedback compensators, M(s).

1. Position Feedback Compensators

Figure 7:
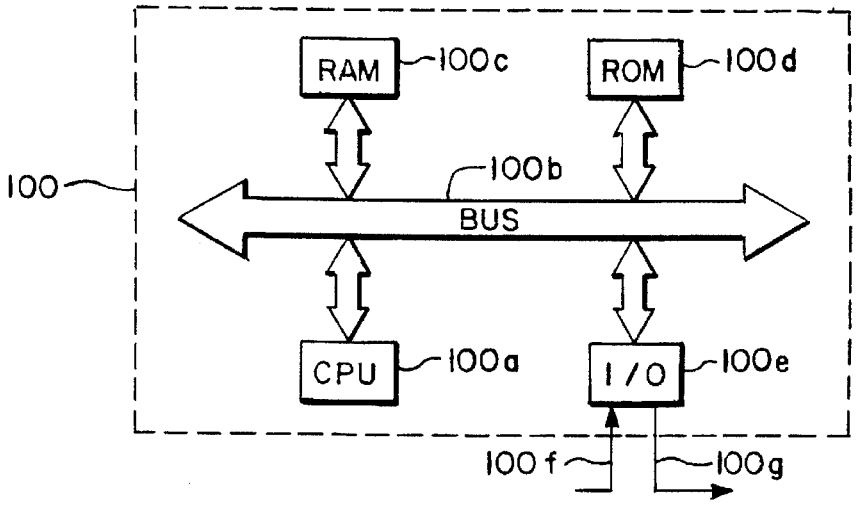
FIG. 7 is a hardware block diagram of a position feedback controller 100 shown in FIG. 6.

As shown in FIG. 7, the position feedback controller 100 such as shown in FIG. 6 may be embodied in a digital signal processor including a central processing unit 100*a* connected by a bus 100*b* to random access memory (RAM) 100*c*, read only memory (ROM) 100*d* and an input/output 100*e*. The corresponding local position error signals $x_{1pe}$, $x_{2pe}$, $y_{1pe}$, $y_{2pe}$, $y_{3pe}$ are received on input line 100*f*, processed, and the coordinated global position error signals $X_{pe}$, $Y_{pe}$, $RX_{pe}$, $RY_{pe}$, $RZ_{pe}$ are provided on output line 100*g*. It should be realized that the signal processor of FIG. 7 is shown for teaching purposes and can also be used to carry out several or all of the functions shown in FIG. 6 so that the identity of the input and output signals on the lines 100*f* and 100*g*, respectively, will depend on the number of signal processors used and the functions performed by each.

In particular, the position feedback compensators 104, 106, 108, 110, 112 can be implemented with a microprocessor architecture as shown in FIG. 7. In any event, they are respectively responsive to the coordinated global position error signals $X_{pe}$, $Y_{pe}$, $RX_{pe}$, $RY_{pe}$, $RZ_{pe}$, for providing the coordinated global force or moment position feedback compensation signals $FC_{Xp}$, $FC_{Yp}$, $FC_{Mxp}$, $FC_{Myp}$, $FC_{Mzp}$. The position feedback compensators 104, 106, 108, 100, 112, mathematically labelled Ctx(s) 104, Cty(s) 106, Crx(s) 108, Cry(s) 110, and Crz(s) 112 compensate for each of the five rigid body degrees-of-freedom. For example, the position feedback compensator 104 translates a coordinated global displacement error signal along the Xc axis into a coordinated global force signal along the Xc axis, while the position feedback compensator 106 translates a coordinated global displacement error signal along the Yc axis into a coordinated global force signal along the Xc axis. Similarly, each of the position feedback compensators 108, 110, 112 translate a corresponding coordinated global error signal about a respective X, Y, Z axis into an associated coordinated global moment signal about the respective axis (i.e., X-Rotation, Y-Rotation and Z-Rotation).

Figure 8:
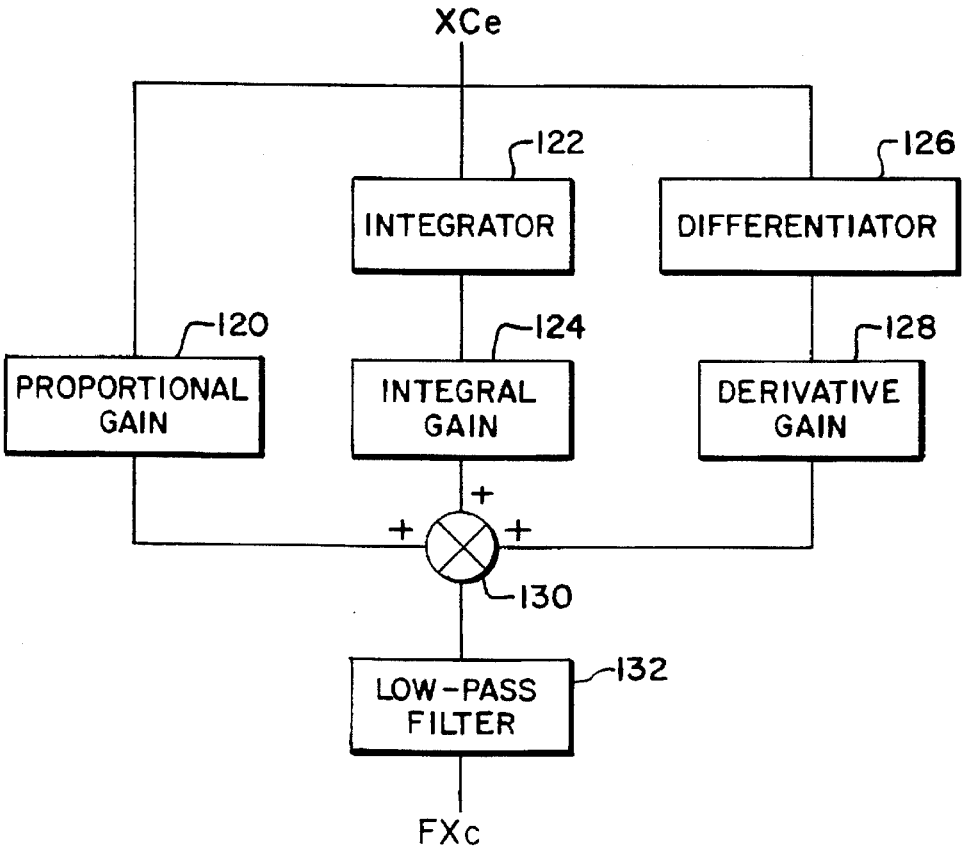
FIG. 8 is a software block diagram of a feedback compensator shown in FIG. 6.

FIG. 8 shows a software block diagram of the position feedback compensators 104, 106, 108, 110 and 112 implemented as a classic proportional-integral-derivative (PID) controller. The position feedback compensators 104, 106, 108, 110 and 112 include a proportional gains means 120, in parallel with an integrator means 122 and an integral gain means 124, and further in parallel with a differentiator means 126 and a derivative gain means 128. The position feedback compensator 104 also includes an adding means 130 and a low-pass filter means 132. The position feedback compensators 104, 106, 108, 110 and 112 can be a proportional-integral (PI) controllers. The scope of the invention is not intended to be limited to any particular kind of position feedback compensator.

Mathematically, a vector of forces and moments for position control is defined as $FC_p=[FC_{Xp}, FC_{Yp}, FC_{Mxp}, FC_{Myp}, FC_{Mzp}]'$, and a diagonal matrix is defined as Cc(s) =diag [Ctx(s), Cty(s), Crx(s), Cry(s), Cyz(s)], such that the global position feedback control is determined mathematically by equation 3, as follows:

$$\{FC_P\}=[C_c(s)]\{X_d-X_{me}\} \qquad \text{Eq. (3)}$$

where $X_d$ is a column vector of the desired rigid body degrees-of-freedom, i.e., $\{X_d\}=[T_1]\{G_d\}$ where $G_d$ is a column vector of the desired gaps.

Figure 9:
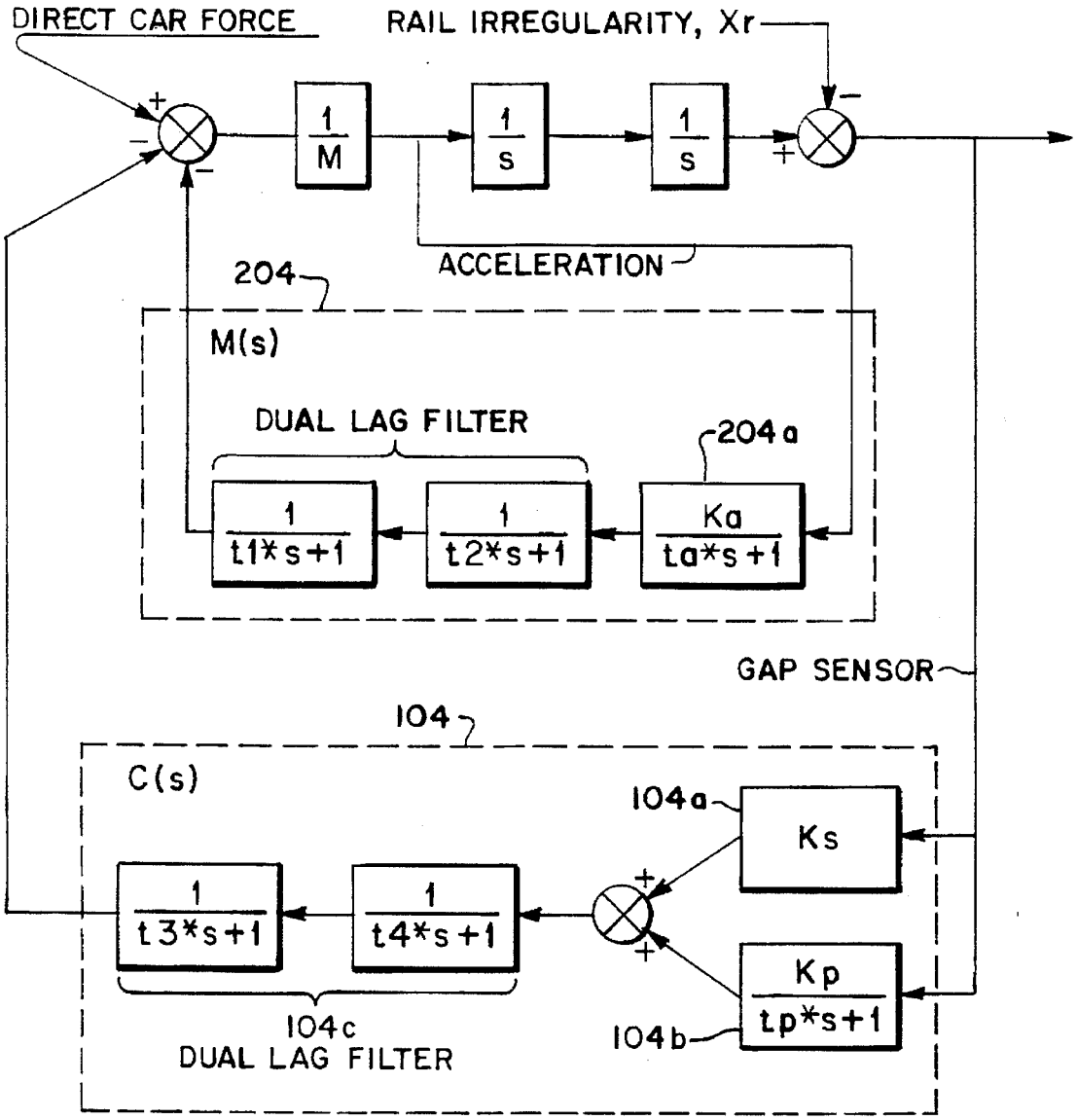
FIG. 9 shows single-degree-of-freedom magnetic bearing control in the form of a Simulink diagram of accelerometer and position feedback compensators shown in FIG. 6.
Figure 9A:
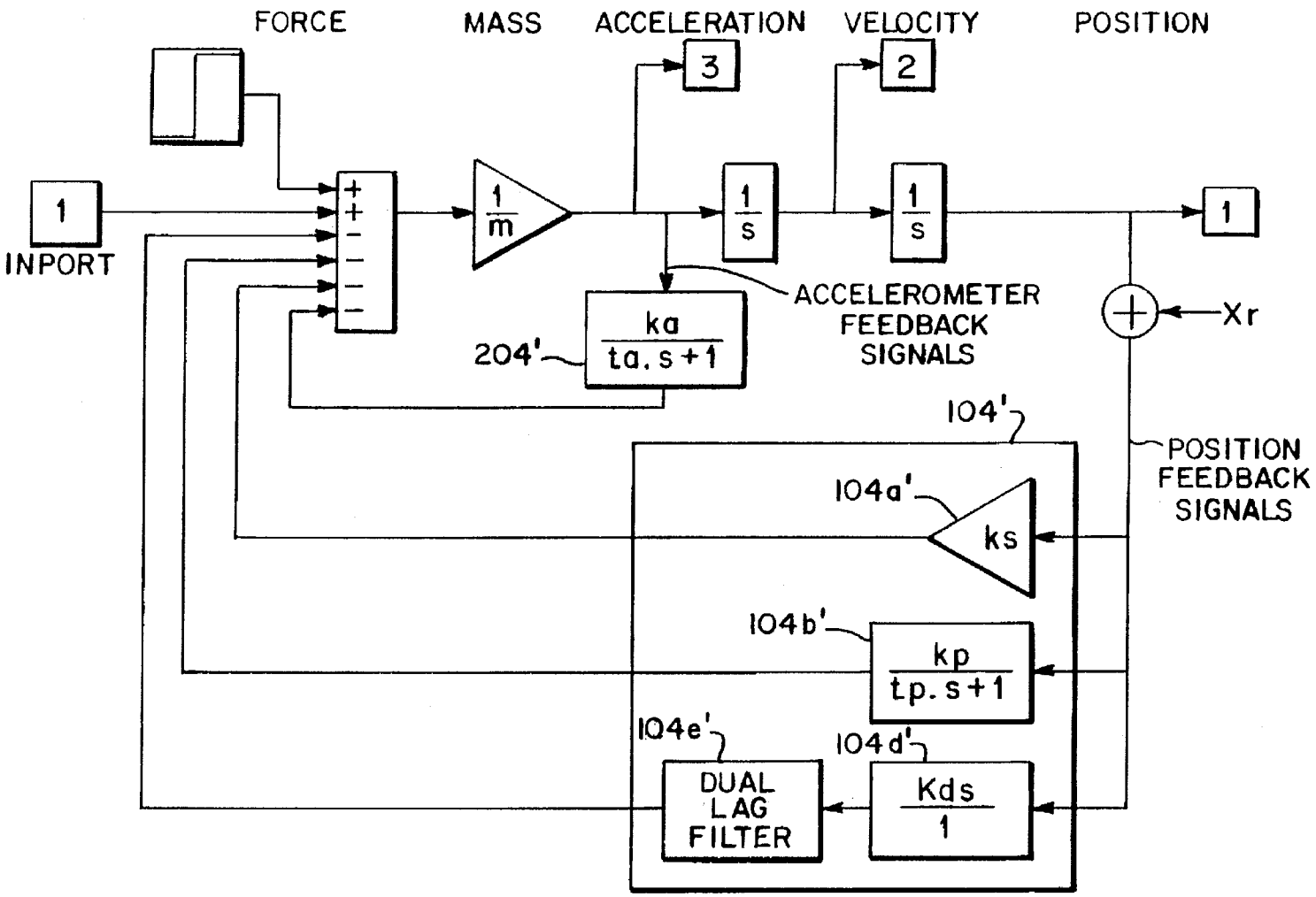
Figure 9B:
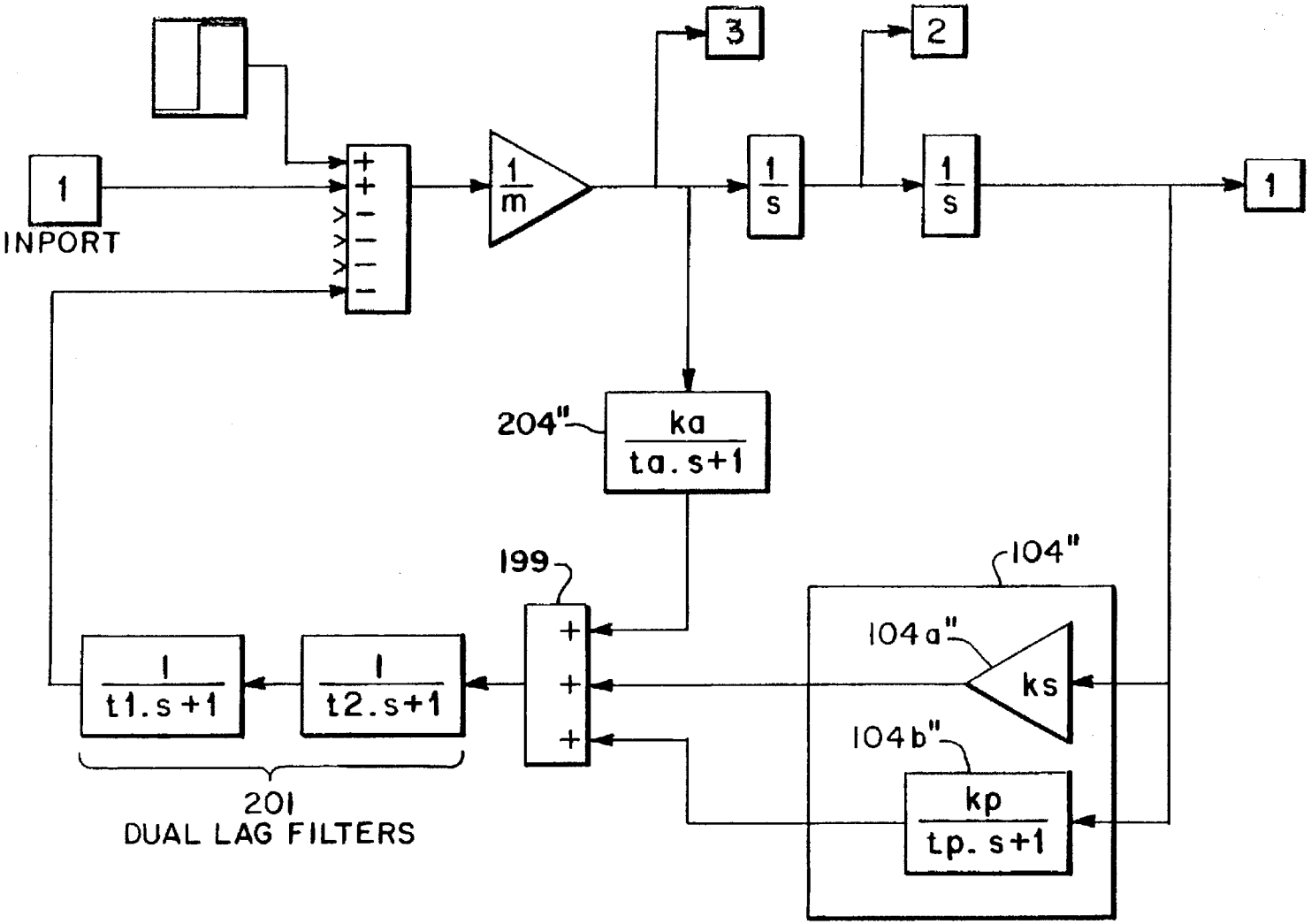

FIG. 9 shows a simulink block diagram of a typical position feedback compensator 104 implemented as a proportional integral controllers (PI) with a dual lag filter, represented mathematically by the Laplace transfer function of Equation 4, as follows:

$$C(s)=\frac{K_s(t_ps+1)+K_p}{(t_ps+1)(t_3s+1)(t_4s+1)} \qquad \text{Eq. 4}$$

where Ks, Kp, tp, t3 and t4 are system constants set to maximize the feedback bandwidth while ensuring appropriate stability margins for each axis of AG centering control. The acceleration, velocity, and position of the stabilized mass are shown, along with the rail irregularity input signals. The forces on the mass are an externally applied force and forces resulting from position and accelerometer feedback. In one embodiment ta=tp=0.001 seconds, t1=0.03 seconds, t2=0.01 seconds, t3=0.015 seconds and t4=0.006 seconds. The gap coordinated controller shares sensor information and generates forces and moments using all guide heads 10, 20, 30, 40 simultaneously, which minimizes the destabilizing effects of loop interactions which are present in active magnetic guidance concepts that use localized single-input, single-output feedback control.

The numerator and denominator of Equation 4 represents the variables for the proportional gain 120 and the integrator 122, the integral gain 124, and the dual low pass filter 132. The constants of the transfer function of Equation 4 are system parameters determined through testing and may have to periodically adjusted over time as the system is used.

As shown, the position feedback controller 104 includes a proportional controls 104*a* and 104*b*. The position feedback constant ks controls the spring rate at higher frequencies, the constant kp controls static spring rate, and the time constant tp controls the frequencies where static feedback is cut off. The position feedback controller 104 also has a dual lag filter 104*c*. The scope of the invention is not however limited to any particular position feedback compensator.

FIG. 9(*a*) and 9(*b*) shows a Simulink diagram of alternative embodiments. FIG. 9(*a*) shows a PID controller having differentiator control 104(d)' and a dual lag filter 104(*e*), which is needed because there is no pure differentiator in system controls, since differentiators inherently have an infinite response and a dynamic response range, which causes undesirable noise in the control system. The dual lag filter 104(*e*)' is needed to eliminate the undesirable noise from the differentiator response when its become saturated.

FIG. 9(*b*) shows a PI position feedback controller 104" and having its outputs provided to a summing junction 199. A dual lag filter 201 is also shown.

2. Accelerometer Feedback Compensators

The local-to-global accelerometer coordinated controller 202 can be implemented either by an analog or digital system. If implemented digitally, the same processor of FIG. 7 can be used to carry out its functions as well or, if separate, its architecture would be similar to the digital signal processor shown in FIG. 7, including a central processing unit 100*a* connected by the bus 100*b* to the RAM 100*c*, the ROM 100*d* and the input/output 100*e*.

The accelerometer feedback controller 200 also includes accelerometer feedback compensators 204, 206, 208, 210, 212, responsive to the global coordinated acceleration signals $X_a$, $Y_a$, $RX_a$, $RY_a$, $RZ_a$, for providing the coordinated global force or moment acceleration feedback compensation signals $FC_{Xa}$, $FC_{Ya}$, $FC_{Mxa}$, $FC_{Mya}$, $FC_{Mza}$. The accelerometer feedback compensators 204, 206, 208, 210, 212, labelled mathematically by a matrix [M(s)]=diag[Mtx(s), Mty(s), Mrx(s), Mry(s), Mrz(s)], which control and compensate for each of the five rigid body degrees-of-freedom.

FIG. 9 shows a typical accelerometer feedback compensators 204, represented mathematically by the Equation:

$$M(s)=\frac{Ka}{(t1*s+1)(t2*s+1)(ta*s+1)},$$

where Ka is the overall feedback gain and t1, t2, and ta are three first order time lags which are adjusted to provide a balance between stability robustness and performance. In one embodiment, t1 would be set around 10 seconds to limit the effects of accelerometer drift (effectively representing integrating action with a first-order high pass filter), and t2 & ta might have values around 0.005 to 0.04 seconds which add roll-off in the vibration feedback loop to enhance system stability robustness.

Using this equation, for example, the accelerometer feedback compensator 204 translates the coordinated global acceleration signals $X_a$ along the Xc axis into the coordinated global force or moment acceleration feedback compensation signals $FC_{Xa}$, along the Xc axis, while the accelerometer feedback compensator 206 translates the coordinated global acceleration signals $Y_a$ along the Yc axis into the coordinated global force or moment acceleration feedback compensation signals $FC_{Ya}$ along the Xc axis. Similarly, each of the accelerometer feedback compensators 208, 210, 212 translate the coordinated global acceleration signals $RX_a$, $RY_a$, $RZ_a$ about a respective X, Y, Z axis into the coordinated global force or moment acceleration feedback compensation signals $FC_{Mxa}$, $FC_{Mya}$, $FC_{Mza}$ about the respective axis (i.e. X-Rotation, Y-Rotation and Z-Rotation). Based on the teachings hereof, any person skilled in the art would appreciate how to implement a typical accelerometer feedback compensator 204, 206, 208, 210, 212.

3. Single Axis Analysis of Coordinated Controller Using Accelerometer Feedback It is important to note that while the design of classic magnetic bearings use only position feedback, the design of a coordinated controller for an elevator application permits the use of accelerometer derived feedback, which can enhance performance and reduce cost. This is because a conventional magnetic bearing requires much more stiffness because they are not supposed to move, and have a frequency bandwidth in the range of about 300 Hertz. In the elevator application, the stiffness of the magnetic bearing is significantly less, and typically have a frequency bandwidth of a few Hertz. In addition, in a conventional magnetic bearing cannot use accelerometer feedback because of a coordinate transformation is necessary.

Since the coordinated control of the axis effectively decouples them the PID controller for each axis can be independently designed. Note, however, that this discussion does not explicitly consider structural resonances. Such resonances will always be present and will limit speed of response. If response speed is made a secondary consideration, a stable loop closure is always possible. The appendix shows a listing written in Matlab programming code for one of the five degrees of freedom, and the discussion below is an analysis of computer simulated test results for the one axis.

In the desired elevator system relatively high static spring rates in the bearings must be achieved. The necessary minimum rates are on the order of 300 N/mm for the front/back (f/b) bearings and 400 N/mm for the side/side (s/s) bearings.

Bearings intended for elevators need not be pure magnetic bearings. Levitation is not needed at all times. While running there must be full levitation. However, while passengers board or exit the car, the magnetic bearings may be permitted to bottom against suitably designed stops.

As shown in the appendix, the bearing computer model is simply a second order system having no mechanical damping. The "plant" transfer function is $$G=1/(m*s^2.)$$

The "controller" transfer function is $$H=(s^2*ka/(ta*s+1))+ks+(kp/(tp*s+1))$$

If accelerometer feedback is used, the controller to be implemented for position feedback is $$H_mod=ks+kp/(tp*s+1).$$

An alternate controller also considered is:

$$H_filt=H/((t1*s+1)*(t2*s+1))$$

H is realizable when accelerometer feedback is used together with H_mod. If no accelerometer is used, H_filt would have to be used.

A step response of the system can be examined in the following example. For instance, the mass is taken as one tonne (1000 kg). Length units are mm when mass is in tonnes. Force units are Newtons. The variable ks is computed as $m*\omega_o^2$, where $\omega_o=2*\pi*fo$ for the example. The position feedback filter has a time constraint tp=30s. The gain of the position feedback filter kp is a parameter. The addition of the variables kp+ks determines the static stiffness of the bearing in N/mm. The variable kp is much greater than the variable ks. Thus the variable kp, for the most part, determines static stiffness. Damping is obtained by feeding back acceleration through a very low pass filter. A gain ka=100 (N/(mm/s$^2$)) and a time constant of ta=10s were used for the acceleration filter.

Figure 10:
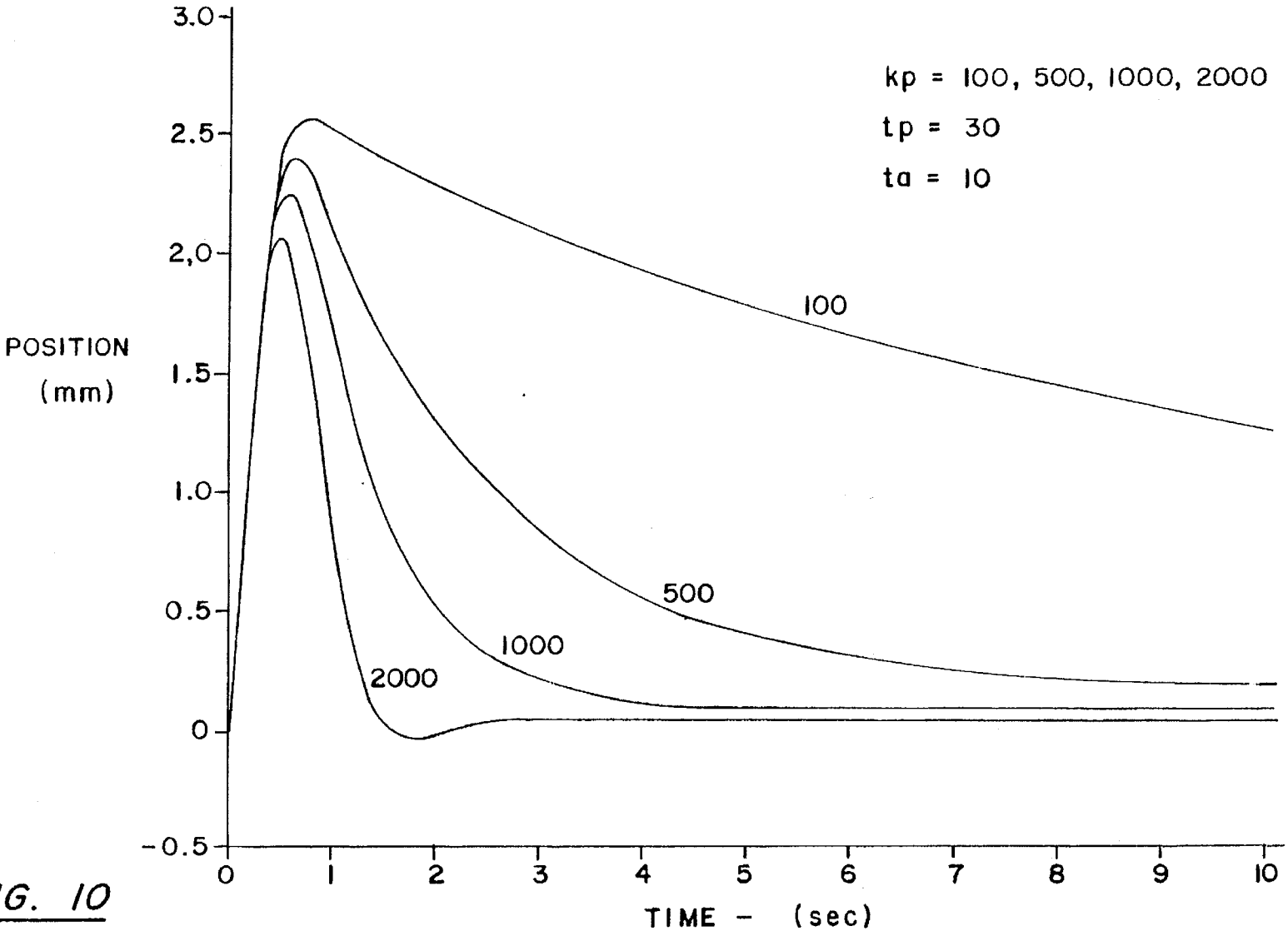
FIG. 10 is a graph of position versus time for a 100 Newton applied step.

The analysis of such a system is shown in FIG. 10 in a position versus time graph when a 100 N step is applied. This provides an opportunity to examine system response under highly exaggerated condition, although this could occur at start up. In an elevator application the force usually ramps up to 100 N in 2 to 5 seconds. The curves in FIG. 12 show that with the variable kp in the range 500–2000, the dynamic performance would be acceptable.

Figure 11A:
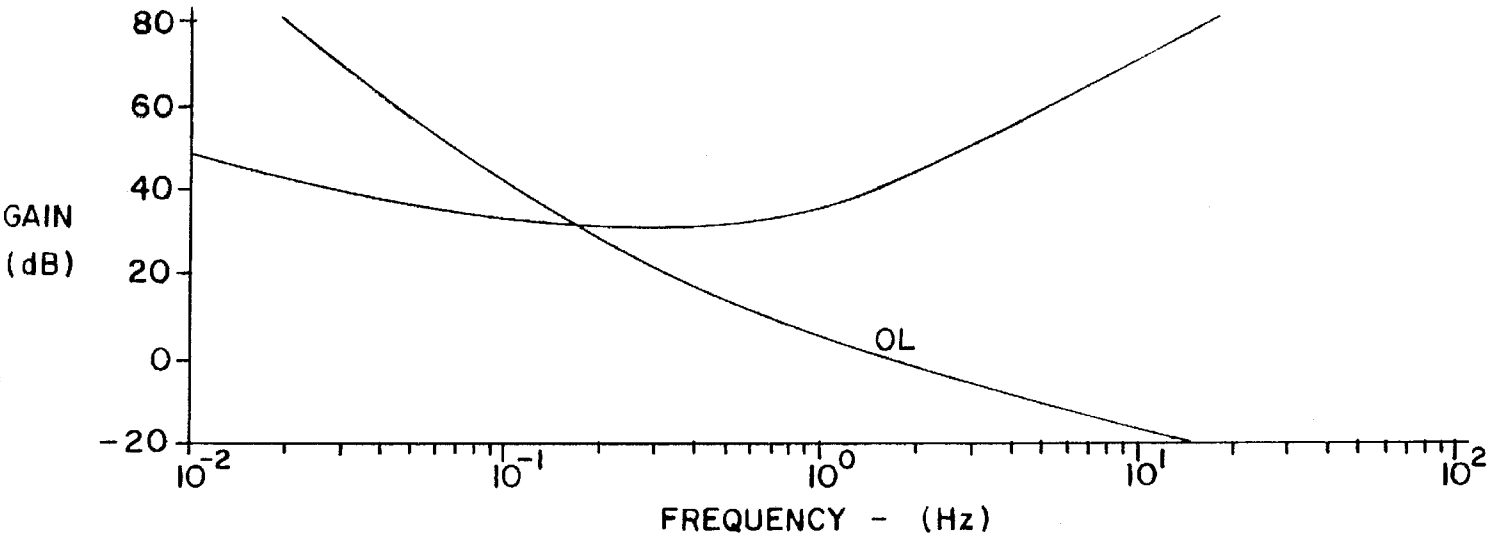
FIG. 11(*a*) and (*b*) shows a Bode plot of a GH transfer function and the inverse closed-loop response from force input to position output.
Figure 11B:
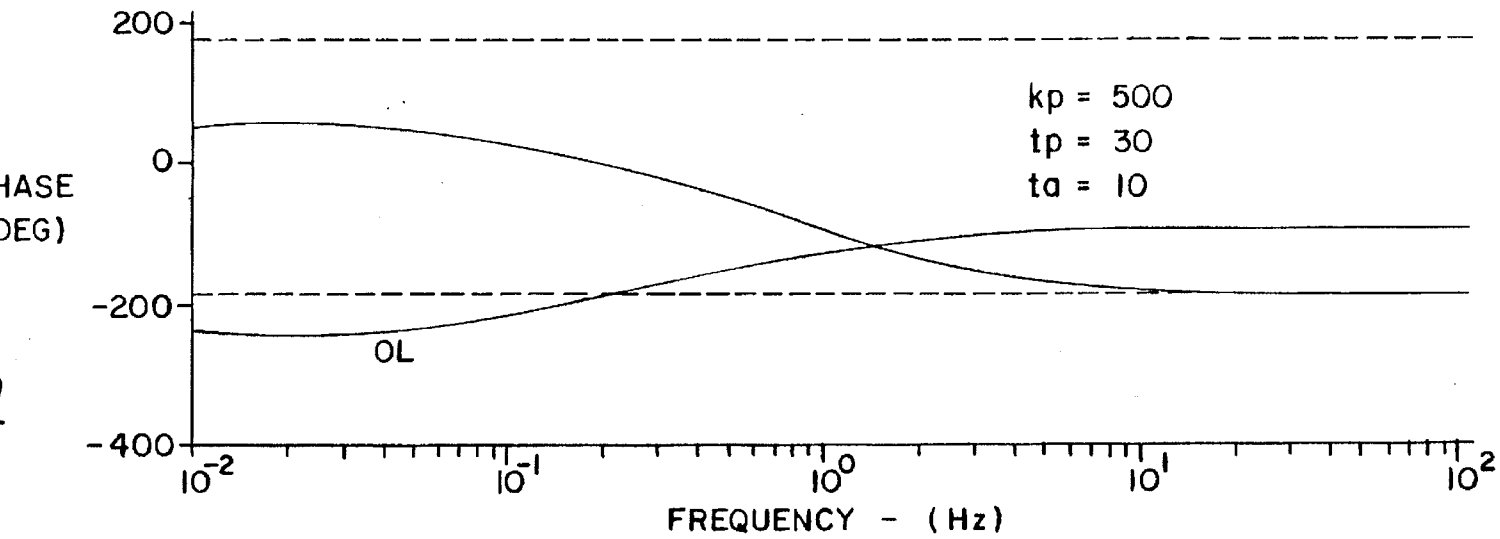
Figure 12A:
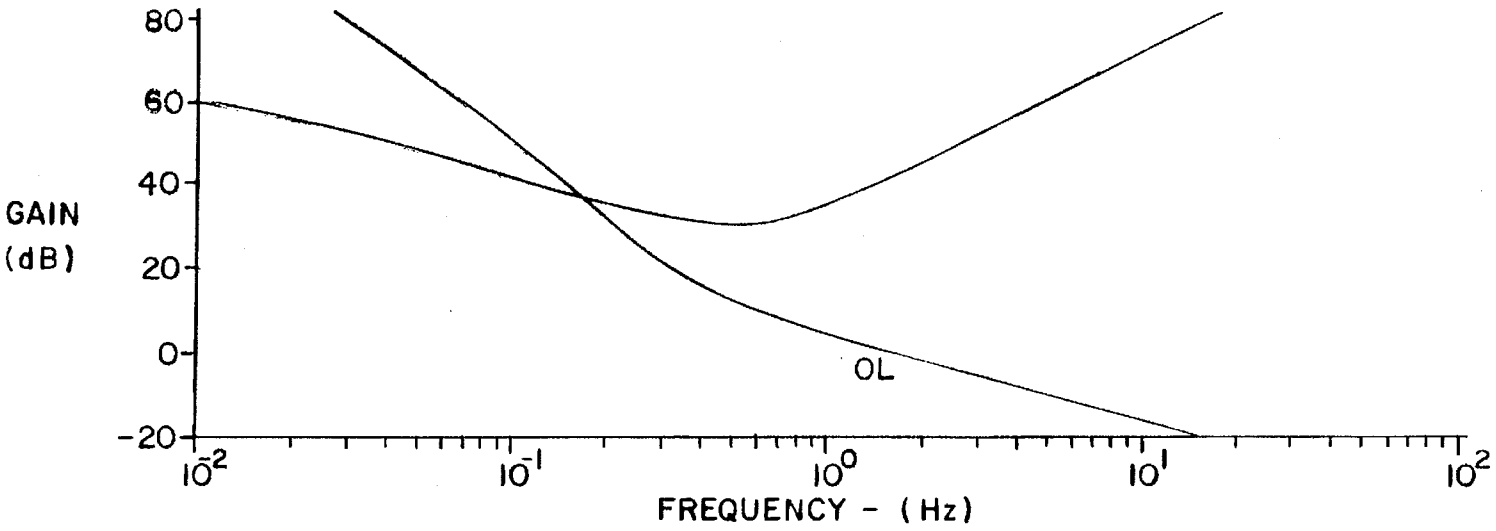
FIG. 12(*a*) and (*b*) shows another Bode plot of a GH transfer function and the inverse closed-loop response from force input to position output.
Figure 12B:
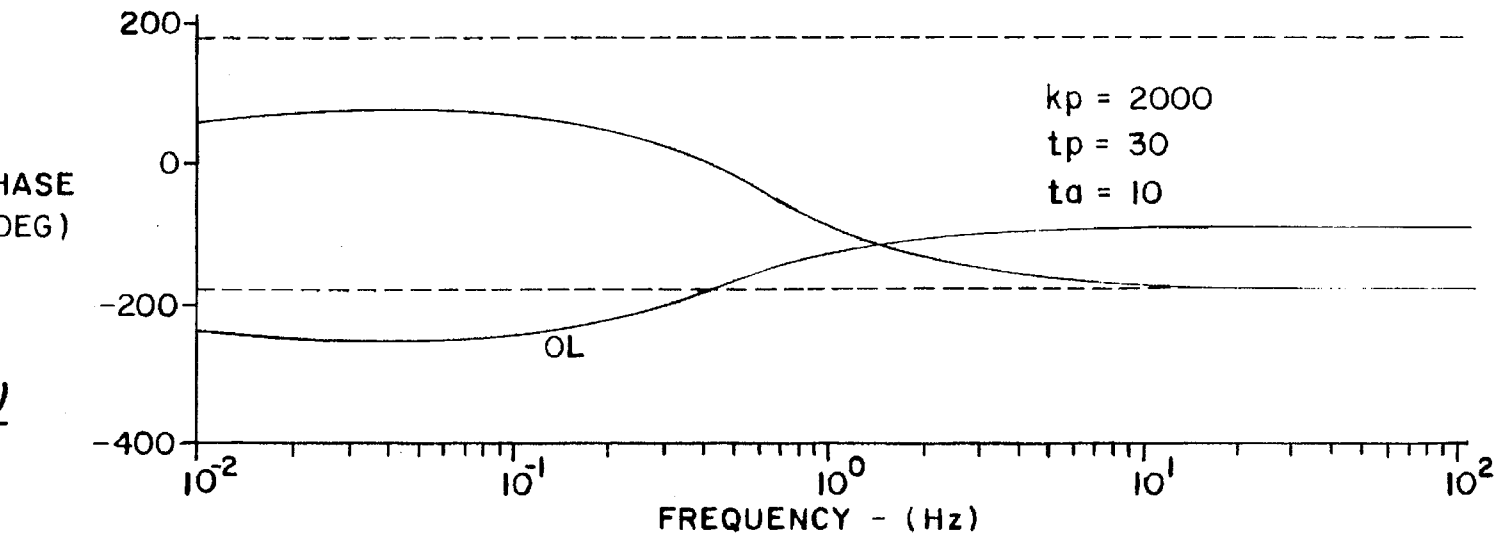

Closed-loop plots are presented to show bearing stiffness as a function of frequency, and open-loop plots are shown to permit assessment of sensitivity to structural resonances in FIGS. 11(*a*), (*b*) and FIGS. 12 (*a*), (*b*).

In particular, FIGS. 11(*a*) and (*b*) show a Bode plot of the transfer function GH and the inverse closed-loop (CL) response from force input to position output. The inverse closed-loop response is the spring rate of the bearing in N/mm. The constants kp=500 N/mm and other parameters are the same as used previously. The open-loop (OL) control crossover (gain=0 dB) frequency is 1.6 Hz. This frequency is controlled primarily by the variable ks. The phase margin is more than 70 degrees. Examination of the closed-loop response shows a gain of 48 Db at 0.01 Hz. The static gain for this system is 54.6 Db (20*log (500+39.4)). The bearing stiffness may be considered adequate for AMG applications.

FIGS. 11(*a*) and (*b*) show a Bode plot of the transfer function GH and the inverse closed-loop response from force input to position output, and shows what happens when the variable kp is increased from 500 to 2000 N/mm. The static gain at 0.01 Hz goes to 60 Db, up 12 Db over FIG. 11. The open-loop (OL) curve shows a crossover at 1.6 Hz, as in FIG. 11. However, neither the susceptance to structural resonances nor the phase margin are increased by increasing kp.

Figure 13A:
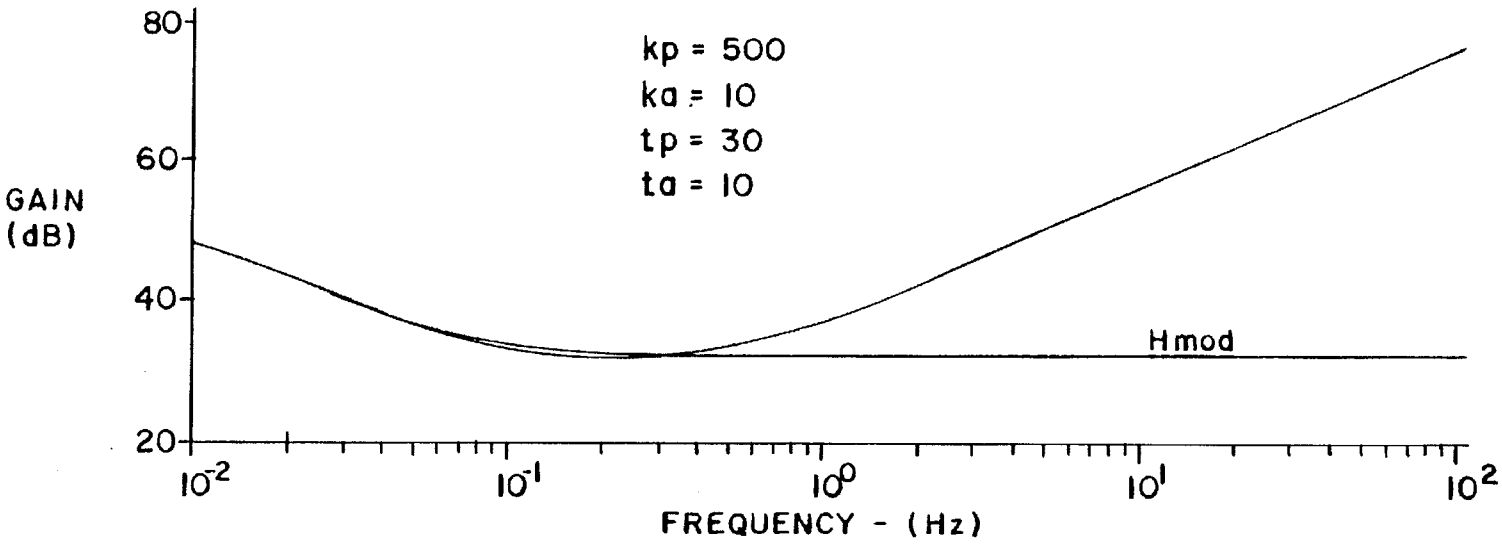
FIGS. 13(*a*) and (*b*) shows a frequency response for the controller.
Figure 13B:
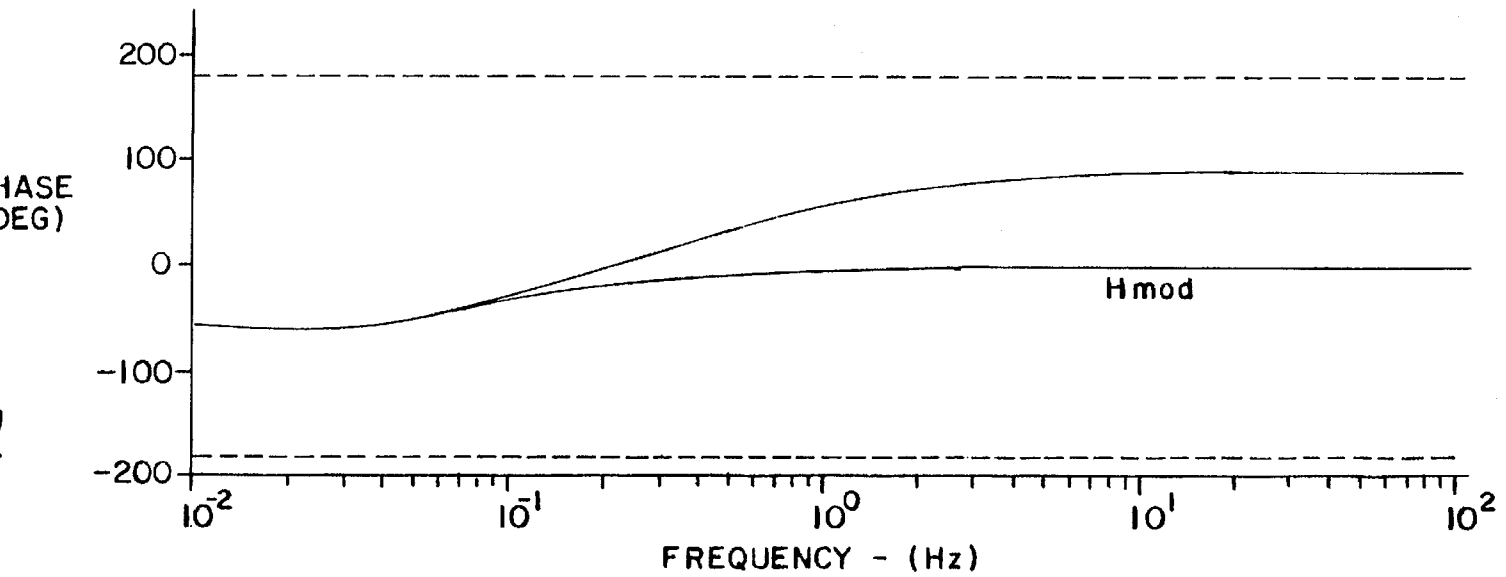

FIGS. 13(*a*) and (*b*) shows the frequency response for the controller. As shown, the controller H cannot be implemented, since its gain continues to rise as frequency increases. The controller Hmod is needed when acceleration feedback is used in the controller.

Figure 14A:
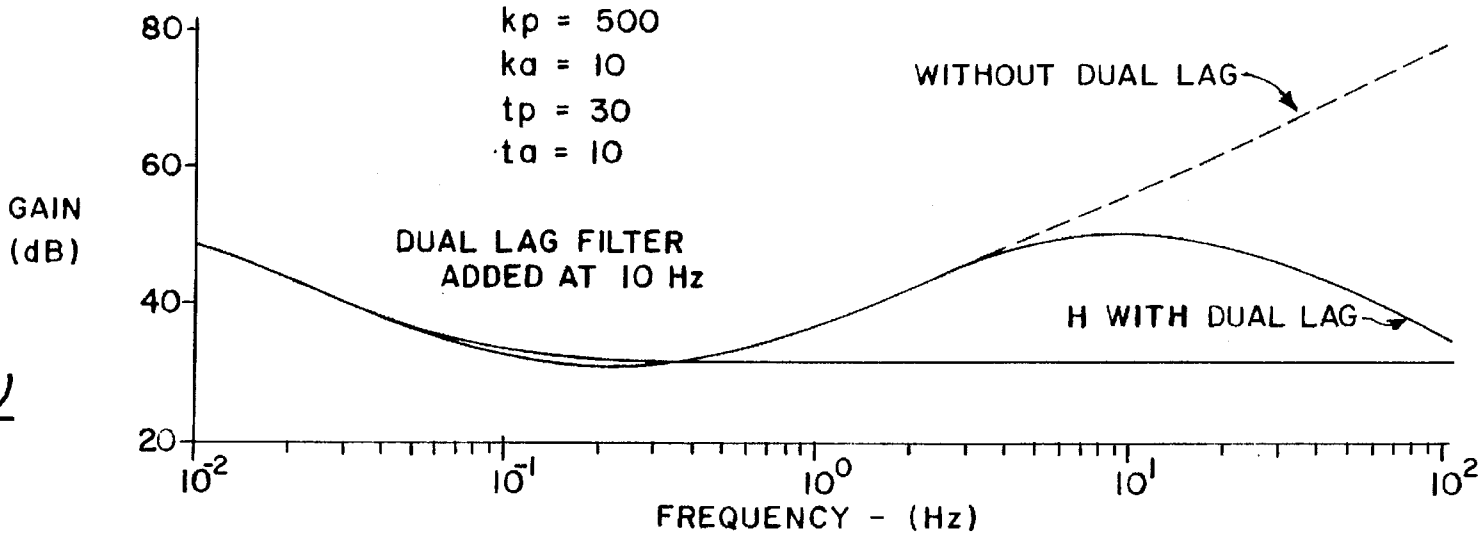
FIGS. 14(*a*) and (*b*) show responses for the controller and (c) FIG. shows a filter for the response in FIG. (b).
Figure 14B:
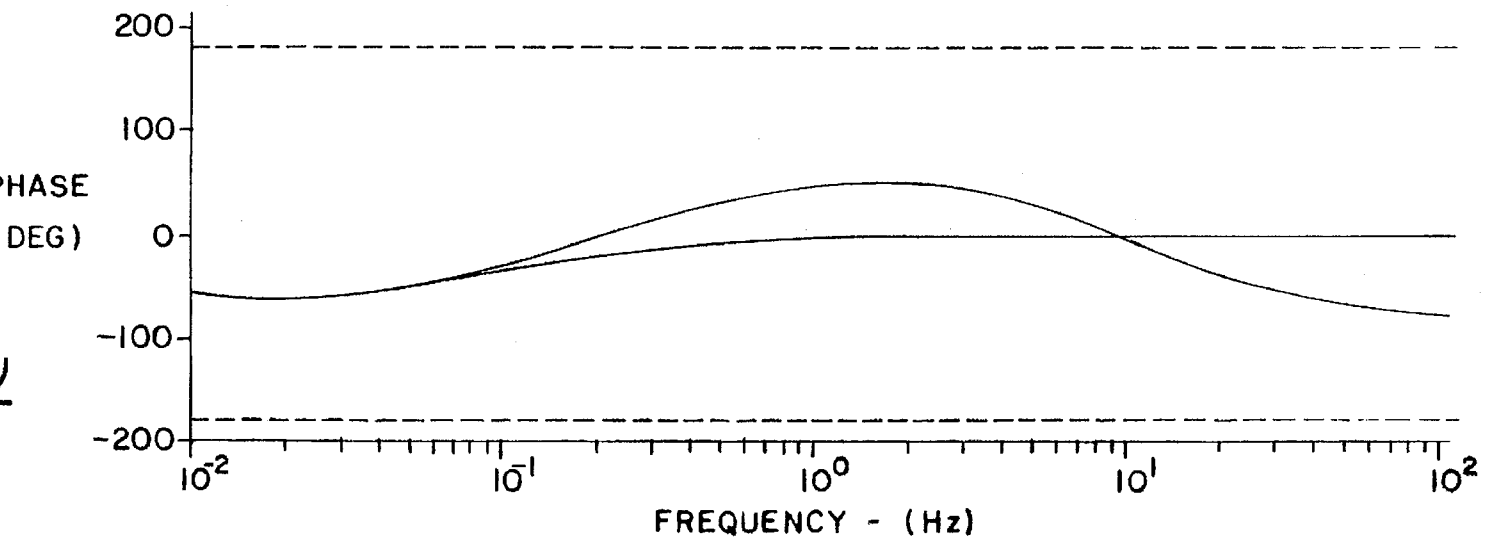
Figure 14C:
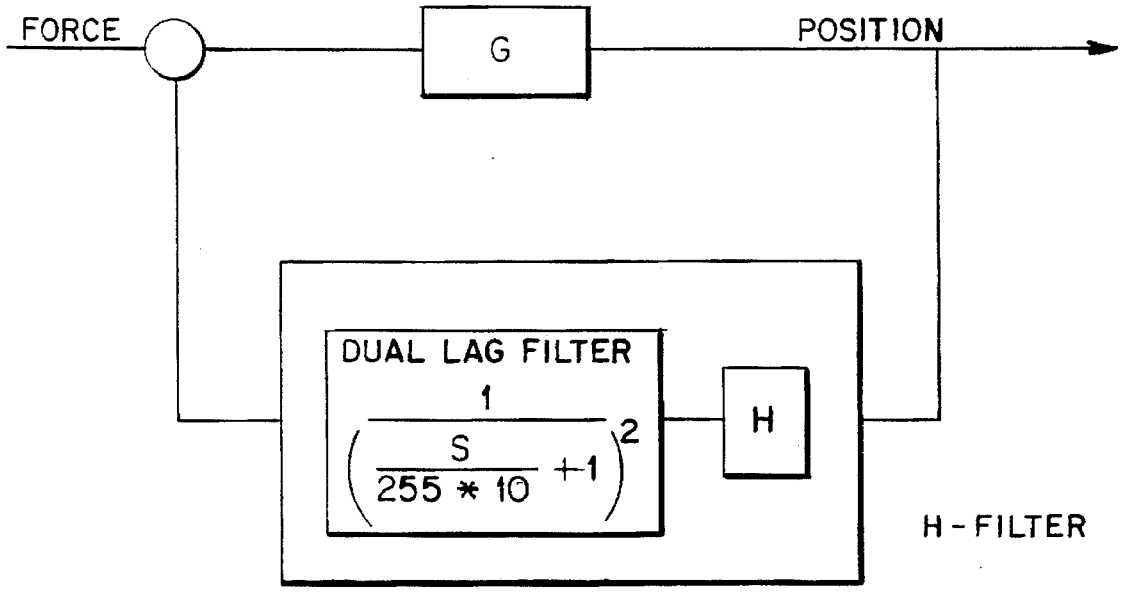

The H controller can be combined with at least a dual lag filter. FIG. 14(*a*), (*b*) shows a Bode plot of gain versus frequency and phase versus frequency and an H-filt with a dual lag filter, and the controller derived from H and a dual lag filter at 10 Hz is shown in FIG. 14(*c*). The breakpoint frequency shown could also be moved lower. System performance is in not degraded when a dual 10 Hz lag filter is used. This was verified by examination of a plot similar to FIG. 11. Stability is not compromised, but ability to reject high-frequency resonances is increased.

The system of FIG. 9(*a*) is now examined. It is a second-order system whose natural frequency is fo (wo^2=ks/m; wo=2*π*fo). The damping ratio of the system is defined by ζ=(kd+ka/ta)/(4*π*fo*m). The natural frequency fo is 1.0 Hz. For kd=0 and ka/ta=10, ζ=0.8. System damping, in theory, may be obtained using either the variables kd or ka. However, use of the variable kd in practice is preferred for two reasons. First, as discussed, the damping signal will have less noise. Second, the damping signal is referenced to inertial space. Use of a damper referenced to inertial space inherently provides vibration damping. The greater the variable ka, the greater will be the damping of vibrations. When the damping signal is derived from relative position, as derived using a position sensor, the vibrations are reduced until the damping ratio goes to approximately 0.3. Beyond that, increase in damping ratio does damp the system but it also couples rail waviness into the elevator. The vibrations coming from rail waviness will increase as damping derived using position feedback is increased above ζ=0.3.

A comparison of performances of coordinated controller using acceleration feedback and coordinated controller not using acceleration feedback indicates that the use of accelerometer feedback enhances the performance of the system. The enhanced performance results because no differentiating is required in the controller, which is in effect a PI controller. Further, an elevator system using accelerometer feedback provides some important advantages. The accelerometer feedback provides damping referenced to inertial space. This is very beneficial in suppression of vibrations. The design of such a controller must also take into account the effects from coupling effects between principal axes of mechanical system, the effect from nonlinearity in the system such as operation on/off stops and saturation of transducers, and the effects from parameter variation caused by heating, etc. Finally, the use of accelerometer feedback in an elevator magnetic bearing having position feedback provides vibration control and damping control. The accelerometer feedback is passed through an integrator or low-pass filter to provide inertially referenced damping. This type of damping is much more effective than viscous (mechanically derived) damping. In a preferred embodiment, there can be feedback of both integrated accelerometer output and the derivative of position to obtain maximum damping. The feedback of both integrated and proportional accelerometer information. This provides inertially-referenced damping plus mass augmentation by electromechanical feedback.

D. Force Coordinator 300

The coordinated control means 16 includes a force coordinator 300 which coordinates the global-to-local force and moment control.

Mathematically, the desired forces and moments at the guide heads 10, 20, 30, 40 are derived from $FC_{PA}$ by the following equation 5:

$$\{CC_{xy}\}=[T_3]\{FC_{PA}\} \qquad \text{Eq. (5)}$$

where $CC_{xy}=[CC_{x1}, CC_{x2}, CC_{y1}, CC_{y2}, CC_{y3}]'$, and where $FC_{PA}=[FC_{Xp}+FC_{Xa}, FC_{Yp}+FC_{Ya}, FC_{Mxp}+FC_{Mxa}, FC_{Myp}+FC_{Mya}, FC_{Mzp}+FC_{Mza}]$, and where $T_3$ is a transformation matrix defined by equation 6, as follows:

$$T3 = \qquad \text{Eq. (6)}$$

$$\begin{bmatrix} \frac{b}{a+b} & 0 & 0 & \frac{-1}{a+b} & 0 \\ \frac{a}{a+b} & 0 & 0 & \frac{1}{a+b} & 0 \\ 0 & \frac{b}{a+b} & \frac{1}{a+b} & 0 & 0 \\ \frac{c}{d+e} & \frac{ae-be}{(a+b)(d+e)} & \frac{-1}{a+b} & 0 & \frac{1}{d+e} \\ \frac{-c}{d+e} & \frac{d}{d+e} & 0 & 0 & \frac{-1}{d+e} \end{bmatrix}$$

The requests from each position feedback compensators 104, 106, 108, 110, 112 and a respective accelerometer feedback compensators 204–212 are summed appropriately (i.e., translate-x, translate-y, rotate-x, rotate-y, and rotate-z) and fed into the force coordinator 300 which utilizes the force control transformation means 314. T3 mathematically represents a transformation matrix used by the transformation means 314 of the force coordinator 300 to convert the global force and moment compensation signals in the global coordinate system GCS into coordinated control signals which control the forces and moments applied in the local coordinate systems $LCS_{10}$, $LCS_{20}$, $LCS_{30}$.

In particular, the force coordinator 300 is responsive the coordinated global force or moment position feedback compensation signals $FC_{Xp}$, $FC_{Yp}$, $FC_{Mxp}$, $FC_{Myp}$, $FC_{Mzp}$, and further responsive to the coordinated global force or moment acceleration feedback compensation signals $FC_{Xa}$, $FC_{Ya}$, $FC_{Mxa}$, $FC_{Mya}$, $FC_{Mza}$, for providing the local force coordinated control signals $CC_{x1}$, $CC_{x2}$, $CC_{y1}$, $CC_{y2}$, $CC_{y3}$. In effect, the force coordinator 300 translates corresponding coordinated global force or moment position feedback compensation signals $FC_{Xp}$, $FC_{Yp}$, $FC_{Mxp}$, $FC_{Myp}$, $FC_{Mzp}$ and coordinated global force or moment acceleration feedback compensation signals $FC_{Xa}$, $FC_{Ya}$, $FC_{Mxa}$, $FC_{Mya}$, $FC_{Mza}$, into corresponding local force coordinated control signals $CC_{x1}$, $CC_{x2}$, $CC_{y1}$, $CC_{y2}$, $CC_{y3}$ which are respectively provided to the analog magnet drivers 140, 142, 144, 146, 148.

The force coordinator 300 includes summing circuits 302, 304, 306, 308, 310, respectively responsive to the coordinated global force or moment position feedback compensation signals $FC_{Xp}$, $FC_{Yp}$, $FC_{Mxp}$, $FC_{Myp}$, $FC_{Mzp}$, and further respectively responsive to the coordinated global force or moment acceleration feedback compensation signals $FC_{Xa}$, $FC_{Ya}$, $FC_{Mxa}$, $FC_{Mya}$, $FC_{Mza}$. The summing circuits 302, 304, 306, 308, 310 respectively provided summed coordinated global force or moment position and acceleration feedback compensation signals $FC_{Xpa}$, $FC_{Ypa}$, $FC_{Mxpa}$, $FC_{Mypa}$, $FC_{Mzpa}$.

The force and moment control transformation means 314 is responsive to the summed coordinated global force or moment position and feedback compensation signal $FC_{Xpa}$, $FC_{Ypa}$, $FC_{Mxpa}$, $FC_{Mypa}$, $FC_{Mzpa}$, for providing the global-to-local force and moment coordinated control signals $CC_{x1}$, $CC_{x2}$, $CC_{y1}$, $CC_{y2}$, $CC_{y3}$.

The force and moment control transportation means 314 can be implemented with either an analog or digital circuit. Its function can be carried out by the same signal processor as used for the centering controller 100 as shown in FIG. 7 or may be carried out in a separate signal processor similar to that shown in FIG. 7 having a central processing unit 100*a* connected by a bus 100*b* to a RAM 100*c*, a ROM 100*d* and an input/output 100*e*.

IV. The Local Force Generating Means 18

As shown in FIG. 6, the AMG system includes analog magnet drivers 140, 142, 144, 146 and 148 at the local level of control which modulate current to the coils of the electromagnets to create bi-directional force generators from the six electromagnet pairs. It should be realized that other types of drivers may be used for both electromagnet and other types of actuators that may be used.

In general, the analog magnet drivers 140, 142, 144, 146, 148 are responsive to the local force coordinated control signals $CC_{x1}$, $CC_{x2}$, $CC_{y1}$, $CC_{y2}$, $CC_{y3}$, for providing the associated local coordinated magnetic forces $F_{x1}$, $F_{x2}$, $F_{y1}$, $F_{y2}$, $F_{y3}$ to at least three of the guide heads 10, 20, 30. The analog magnet drivers 140, 142, 144, 146 and 148 may be as shown in U.S. Pat. No. 5,294,757 at FIG. 20.

In particular, at guide head 20 the driver 140 which modulates currents to electromagnets 22, 24, 26 using diode switching logic to produce this controlled force in the $y_2$ axis uses an analog PID control to regulate the error between a force request via line 28 and the difference of the square of flux sensor signals 14 and 15. Both the diode switching logic and PID control are known in the art are described in the aforementioned U.S. Pat. No. 5,294,757.

Alternate forms of the centering controller 100, vibration controller 200, and force coordinator 300 could be readily developed for alternative elevator AG system sensor and/or actuator configurations. What has been presented is an elevator AG system which controls the five elevator rigid body motions with a minimum set of sensing and actuation. However, other embodiments are possible which use redundant sensing and/or actuation.

V. Dynamic Flex Estimator 400

In general, there will be a static twist in the elevator car frame such that the front-to-back gaps f/b are not planar, and may introduce error into the AMG system.

To overcome this, as shown in FIG. 6 the present invention includes a dynamic frame flex estimator 165 which cooperates with a frame flex feedback controller 170. The dynamic frame flex estimator 165 translates the locally measured gaps $G_m$ into a nominal rigid body predicted position, $Y_4o$. A summer 164 adds the nominal rigid body predicted position $Y_4o$ and a static deformation signal $y_4$ bias 162 at the $y_4$ axis, and provides a desired local gap signal $y_{4d}$ which is added at summer 168 to the measured error signal $Y_{4m}$, resulting in a dynamic deflection signal $dy_4$. The dynamic deflection signal $dy_4$ is provided to the frameflex feedback controller 170.

As shown in FIG. 6, the remaining f/b control axis, $y_4$, is used to control the amount of dynamic f/b flexing in the elevator frame 14. A value for the f/b gap in the $y_4$ axis is generated from the $G_m$ vector of measured gaps based on the assumption of rigid body (non-flexing) motion. Mathematically, the nominal rigid body predicted position, $Y_4o$, is determined by equation 7, as follows:

$$Y_4o=[0\ 1\ a\ 0\ -e]\ [T_1]\ \{G_m\} \qquad \text{Eq. (7)}$$

Multiplying out these matrices, one gets in equation 8:

$$Y_4o=[T_2]\ \{G_m\} \qquad \text{Eq. (8)}$$

where $$T_2=[0\ 0\ 1\ -1\ 1].$$

A measurement of the static deformation at the $y_4$ axis, $y_4$ bias, is estimated from the local gap measurement signals $y_1$, $y_2$, $y_3$ and $y_4$ from the front-to-back f/b gap sensors. The measurement of the static deformation at the $y_4$ axis, $y_4$ bias, is estimated from initial readings ($Y_1i$, $Y_2i$, $Y_3i$ and $Y_4i$) from the front-to-back f/b sensors, by equation 9, as follows:

$$Y_4\ \text{bias}=Y_2i+Y_4i-Y_1i-Y_3i \qquad \text{Eq. (9)}$$

Thus, the amount of dynamic deflection in the front-to-back axis f/b at guide head 26 is defined by equation 10, as follows:

$$Dy_4=Y_4o=Y_4\ \text{bias}-Y_4 \qquad \text{Eq. (10)}$$

A feedback controller 170 ($C_4(s)$), similar in form to the feedback compensators 140, 142, 144, 146 and 148 with ki=0, could then be implemented to control the amount of elevator dynamic frame flex.

The desired setpoints for the AMG centering control system are set during initial system setup. The components of $G_d$ will be set to equalize the front and back gaps on all front-to-back f/b axes and to equalize the left and right side gaps on all s/s axes.

VI. Alternative Embodiment

The scope of the invention is not intended to be limited to generating five local force coordinated control signals $CC_{x1}$, $CC_{x2}$, $CC_{y1}$, $CC_{y2}$, $CC_{y3}$. For example, the local force coordinated control signals can include a sixth control signal $CC_{y4}$ generated for the guide head 40. This approach utilizes all six force generation electromagnet pairs and gap sensors to control the five rigid body degrees-of-freedom. That is, the rigid body motions in local coordinate system $LCS_i$ can be determined from the rigid body motions in the global coordinate system GCS as:

$$\begin{bmatrix} X1 \\ X2 \\ Y1 \\ Y2 \\ Y3 \\ Y4 \end{bmatrix} = \begin{bmatrix} 1 & 0 & 0 & -a & -c \\ 1 & 0 & 0 & b & -c \\ 0 & 1 & a & 0 & d \\ 0 & 1 & -b & 0 & d \\ 0 & 1 & -b & 0 & -e \\ 0 & 1 & a & 0 & -e \end{bmatrix} \begin{bmatrix} Xc \\ Yc \\ \theta_x \\ \theta_y \\ \theta_z \end{bmatrix}$$

which can be written in compact matrix notation by equation 11 as follows:

$$G_m=AX_m \qquad \text{Eq. (11)}$$

One can then determine an estimate of the global coordinate system GCS degrees of freedom using the full set of local coordinate system LCS gap sensor readings by using a left-inverse of the matrix A. That is, a matrix B defined by equation 12 such that:

$$BA=I_5 \quad \text{Eq. (12)}$$

One such left-inverse can be found to minimize the error in estimate of the global coordinate system GCS degrees of freedom in the form of equation 13:

$$B=(A^{\tau}A)^{-1}A^{\tau} \quad \text{Eq. (13)}$$

See Gilbert Strang, "Linear Algebra And Its Applications", Academic Press Inc., 1976, pp. 106–107.

For this specific case, this results in the following:

$$T1=\begin{bmatrix} \frac{b}{a+b} & \frac{a}{a+b} & \frac{c}{2(d+e)} & \frac{c}{2(d+e)} & \frac{-c}{2(d+e)} & \frac{-c}{2(d+e)} \\ 0 & 0 & \alpha_1 & \alpha_2 & \alpha_3 & \alpha_4 \\ 0 & 0 & \frac{1}{2(a+b)} & \frac{-1}{2(a+b)} & \frac{-1}{2(a+b)} & \frac{1}{2(a+b)} \\ \frac{-1}{a+b} & \frac{1}{a+b} & 0 & 0 & 0 & 0 \\ 0 & 0 & \frac{1}{2(d+e)} & \frac{1}{2(d+e)} & \frac{-1}{2(d+e)} & \frac{-1}{2(d+e)} \end{bmatrix}$$

where $$\alpha_1=\frac{-(ad-bd-ae-3be)}{4(a+b)(d+e)}$$

$$\alpha_2=\frac{ad-bd+3ae+be}{4(a+b)(d+e)}$$

$$\alpha_3=\frac{3ad+bd+ae-be}{4(a+b)(d+e)}$$

$$\alpha_4=\frac{ad+3bd-ae+be}{4(a+b)(d+e)}$$

It can be easily shown, in a similar fashion, that the desired forces at the six guide heads can be related to Fc by equation 14, as follows:

$$CC_{xy}=[T3]\{Fc\}, \quad \text{Eq. (14)}$$

where T3 is a transformation defined as:

$$\begin{bmatrix} CC_{x1} \\ CC_{x2} \\ CC_{y1} \\ CC_{y2} \\ CC_{y3} \\ CC_{y4} \end{bmatrix}=[T3]\begin{bmatrix} Fx \\ Fy \\ Mx \\ My \\ Mz \end{bmatrix}$$

and $$\begin{bmatrix} Xc \\ Yc \\ \theta_x \\ \theta_y \\ \theta_z \end{bmatrix}=[T1]\begin{bmatrix} X1 \\ X2 \\ Y1 \\ Y2 \\ Y3 \\ Y4 \end{bmatrix}$$

Matrix T1 is a transposition of matrix T3 and vice versa.

Thus, one could expand the elevator AG system to include redundant sensing (e.g., including yp4e position and/or y4a sensors and adding another column to the T1 and/or T4 matrices respectively) and/or redundant actuation (e.g., including Ccy4 actuation by adding another row to the T3 matrix).

As shown in FIG. 6, the force coordinator 314 provides the additional local force coordinated control signals $CC_{y4}$. A summer 312 adds these signals to compensation signals $C_4(s)$ from the feedback compensator 170, for providing a biased local force coordinated control signals $CC_{y4}'$, which drives the analog magnetic driver 150. In a system that did not include a dynamic flex control, the additional local force coordinated control signals $CC_{y4}$ could also be coupled directly to the analog magnetic driver 150.

As mentioned above, the coordinated control system may also be used in other active guidance systems such as elevator systems having an Active Roller Guide as described in U.S. Pat. No. 5,294,757 to potentially increase effectiveness of the vibration suppression.

It will thus be seen that the objects set forth above, and those made apparent from the preceding descriptions, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An elevator system including an elevator car (12) having a frame that operates on guide rails of an elevator shaft of a building, the elevator car (12) having controlled rigid body motions in a global coordination system (X, Y, Z) kinematically defined by at least five degrees of freedom including side-to-side translation along the X axis, front-to-back translation along the Y axis, a pitch rotation about the X axis, a roll rotation about the Y axis, and a yaw rotation about the Z axis, comprising:

local parameter sensing means (14), responsive to local parameters sensed in each of the five degrees of freedom in the global coordination system (X, Y, Z), for providing local parameter signals ($G_m$, $A_m$);

coordinated control means (16), responsive to the local parameter signals ($G_m$, $A_m$), for providing coordinated control signals ($CC_{x1}$, $CC_{x2}$, $CC_{y1}$, $CC_{y2}$, $CC_{y3}$); and local force generating means (18), responsive to the coordinated control signals ($CC_{x1}$, $CC_{x2}$, $CC_{y1}$, $CC_{y2}$, $CC_{y3}$), for providing coordinated local forces ($F_{x1}$, $F_{x2}$, $F_{y1}$, $F_{y2}$, $F_{y3}$) to maintain desired gaps between the frame and the guide rails to control coordinately the position of the elevator car (12) with respect to the elevator shaft of the building, wherein rigid body motions of the elevator car (12) in a global coordination system (X, Y, Z) are kinematically defined by at least five degrees of freedom including side-to-side translation along the X axis, front-to-back translation along the Y axis, a pitch rotation about the X axis, a roll rotation about the Y axis, and a yaw rotation about the Z axis.

2. An elevator system according to claim 1, wherein the local parameter signals ($G_m$, $A_m$) include local position error signals ($G_{me}$); and wherein the coordinating control means (16) includes a position feedback coordinated controller (100), responsive to the local position error signals ($G_m$), for providing coordinated global force or moment position feedback compensation signals ($FC_{Xp}$, $FC_{Yp}$, $FC_{Mxp}$, $FC_{Myp}$, $FC_{Mzp}$).

3. An elevator system according to claim 2, wherein the position feedback coordinated controller (100) includes a local-to-global coordinated position controller (102), responsive to local position error signals ($x_{1pe}$, $x_{2pe}$, $y_{1pe}$, $y_{2pe}$, $y_{3pe}$) in the local position error signals ($G_m$, $G_{me}$) for providing coordinated global position error signals ($X_{pe}$, $Y_{pe}$, $RX_{pe}$, $RY_{pe}$, $RZ_{pe}$).

4. An elevator system according to claim 3, wherein the controller (100) includes position feedback compensators (104, 106, 108, 110, 112), responsive to the coordinated global position error signals ($X_{pe}$, $Y_{pe}$, $RX_{pe}$, $RY_{pe}$, $RZ_{pe}$), for providing the coordinated global force or moment position feedback compensation signals ($FC_{Xp}$, $FC_{Yp}$, $FC_{Mxp}$, $FC_{Myp}$, $FC_{MZp}$).

5. An elevator system according to claim 4, wherein each of the position feedback compensators (104, 106, 108, 110, 112) is a proportional-integral derivative controller.

6. An elevator system according to claim 1, wherein the coordinated control means (16) includes an accelerometer feedback coordinated controller (200), responsive to local acceleration signals ($A_m$) including ($x_{1a}$, $x_{2a}$, $y_{1a}$, $y_{2a}$, $y_{3a}$), for providing coordinated global force or moment acceleration feedback compensation signals ($FC_{Xa}$, $FC_{Ya}$, $FC_{MXa}$, $FC_{MYa}$, $FC_{Mza}$).

7. An elevator system according to claim 6, wherein the accelerometer feedback coordinated controller (200) includes a local-to-global accelerometer coordinated controller (202), responsive to the local acceleration signals ($x_{1a}$, $x_{2a}$, $y_{1a}$, $y_{2a}$, $y_{3a}$), for providing coordinated global acceleration signals ($X_a$, $Y_a$, $RX_a$, $RY_a$, $RZ_a$).

8. An elevator system according to claim 7, wherein the local-to-global accelerometer coordinated controller (202) includes accelerometer feedback compensators (204, 206, 208, 210, 212), responsive to the coordinated global acceleration signals ($X_a$, $Y_a$, $RX_a$, $RY_a$, $RZ_a$), for providing the coordinated global force or moment acceleration feedback compensation signals ($FC_{Xa}$, $FC_{Ya}$, $FC_{MXa}$, $FC_{MYa}$, $FC_{MZa}$).

9. An elevator system according to claim 8, wherein each of the accelerometer feedback compensators (104, 106, 108, 110, 112) is a proportional-integral controller.

10. An elevator system according to claim 1, wherein the coordinated control means (16) includes a global-to-local force and moment coordinated controller (300), responsive coordinated global force or moment position feedback compensation signals ($FC_{Xp}$, $FC_{Yp}$, $FC_{MXp}$, $FC_{MYp}$, $FC_{MZp}$), and further responsive to coordinated global force or moment acceleration feedback compensation signals ($FC_{Xa}$, $FC_{Ya}$, $FC_{MXa}$, $FC_{MYa}$, $FC_{MZa}$), for providing the coordinated control signals ($CC_{x1}$, $CC_{x2}$, $CC_{y1}$, $CC_{y3}$).

11. An elevator system according to claim 10, wherein the global-to-local force and moment coordinated controller (300) includes summing circuits (302, 304, 306, 308, 310), responsive to the coordinated global force or moment position feedback compensation signals ($FC_{Xp}$, $FC_{Yp}$, $FC_{MXp}$, $FC_{MYp}$, $FC_{MZp}$), and further responsive to the coordinated global force or moment acceleration feedback compensation signals ($FC_{Xa}$, $FC_{Ya}$, $FC_{MXa}$, $FC_{MYa}$, $FC_{MZa}$), for providing summed coordinated global force or moment position and acceleration feedback compensation signals ($FC_{Xpa}$, $FC_{Ypa}$, $FC_{MXpa}$, $FC_{MYpa}$, $FC_{MZpa}$).

12. An elevator system according to claim 11, wherein the global-to-local force and moment coordinated controller (300) includes force and moment transformation means (314), responsive to the summed coordinated global force or moment position and feedback compensation control signal ($FC_{Xpa}$, $FC_{Ypa}$, $FC_{MXpa}$, $FC_{MYpa}$, $FC_{MZpa}$), for providing the coordinated control signals ($CC_{x1}$, $CC_{x2}$, $CC_{y1}$, $CC_{y2}$, $CC_{y3}$).

13. An elevator system according to claim 1, wherein the driver means (18) includes analog magnet drivers (140, 142, 144, 146, 148), responsive to the the coordinated control signals ($CC_{x1}$, $CC_{x2}$, $CC_{y1}$, $CC_{y2}$, $CC_{y3}$), for providing the associated coordinated magnetic forces to at least three of the guide heads (10, 20, 30).

14. An elevator system according to claim 1, wherein the local parameter sensing means (14) includes at least one non-contact position sensor for measuring air gaps between the frame of the elevator car and the guide rails, and for providing the local parameter signals ($G_m$, $A_m$).

15. An elevator system according to claim 1, wherein the local parameter signals ($G_m$, $A_m$) include local position error signals ($G_{me}$); and wherein the elevator system further comprises a dynamic flex estimator means (400), responsive to the local position error signals ($G_{me}$), for providing an additional global coordinated force position feedback compensation control signal ($FC_{Y4p}$) to compensate for any dynamic flexing in the frame of the elevator car (12).

16. An elevator system according to claim 15, wherein the dynamic flex estimator means (400) includes a dynamic flex estimator means (160), the local position error signals ($G_m$), for providing a nominal rigid body position signal ($Y_4$o).

17. An elevator system according to claim 16, wherein the dynamic flex estimator means (400) includes a summing circuit (164), responsive to the nominal rigid body position signal ($Y_4$o), and further responsive to a dynamic deflection bias signal ($Y_4$bias), for providing an estimated rigid body position signal ($Y_4$est).

18. An elevator system according to claim 17, wherein the dynamic flex estimator means (400) includes a subtracting circuit (168), responsive to the estimated rigid body position signal ($Y_4$est), and further responsive to a measured rigid body position signal ($Y_4$m), for providing a differential signal ($Dy_4$).

19. An elevator system according to claim 18, wherein the dynamic flex estimator means (400) includes a position feedback compensation means (170), responsive to the differential signal ($Dy_4$), for providing the additional global coordinated force position feedback compensation control signal ($FC_{Y4p}$).

20. An elevator system according to claim 19, wherein the force generating means (18) includes an analog magnet driver (150), responsive to the additional global coordinated force position feedback compensation control signal ($FC_{Y4p}$), for providing a dynamic flex local force ($F_{y4}$) to a four guide head (26).

21. An elevator system according to claim 2, wherein the elevator system further comprises a learn-the-rail system 80, including rail map means (80), responsive to a scalar vertical position Vp of the elevator car (12), for providing rail map signals (Xr), including a summing circuit (82), responsive to the rail map signals (Xr), and further responsive to the desired nominal gaps ($G_o$), for providing the associated desired local gap signals ($G_d$), and including subtracting means (95), responsive to the local position error signals $G_m$, and further responsive to associated desired local gap signals $G_d$, for providing measured error signals $G_{me}$ in the form of local position error signals ($x_{1pe}$, $x_{2pe}$, $y_{1pe}$, $y_{2pe}$, $y_{3pe}$).

22. An elevator system according to claim 1, wherein the force coordinator 314 provides an additional local force coordinated control signals $CC_{y4}$.

23. An elevator system according to claim 22, wherein the elevator system further comprises a summer 312 for adding the additional local force coordinated control signals $CC_{y4}$ to an additional global coordinated force position feedback compensation control signal ($FC_{Y4p}$) from the feedback compensator 170, for providing a biased local force coordinated control signals $CC_{y4}'$, which drives the analog magnetic driver 150.

24. An elevator system according to claim 1, wherein the coordinated control means (16) uses sensor information from all active guides and generates coordinated forces and movements to all active guides.

* * * * *